US012336582B2

(12) United States Patent
Chipman et al.

(10) Patent No.: US 12,336,582 B2
(45) Date of Patent: Jun. 24, 2025

(54) MODULAR-SEGMENT, TAPE-IN, LASH EXTENSION APPARATUS AND METHODS

(71) Applicant: Pro Lash, Inc., Vineyard, UT (US)

(72) Inventors: Zachary Chipman, Vineyard, UT (US); Haley Chipman, Vineyard, UT (US); Hayden Finlinson, Vineyard, UT (US)

(73) Assignee: Pro Lash, Inc., Vineyard, UT (US)

( * ) Notice: Subject to any disclaimer, the term of this patent is extended or adjusted under 35 U.S.C. 154(b) by 235 days.

(21) Appl. No.: 17/729,988

(22) Filed: Apr. 26, 2022

(65) Prior Publication Data

US 2022/0338585 A1 Oct. 27, 2022

Related U.S. Application Data

(60) Provisional application No. 63/305,498, filed on Feb. 1, 2022, provisional application No. 63/278,366, filed on Nov. 11, 2021, provisional application No. 63/273,382, filed on Oct. 29, 2021, provisional application No. 63/180,464, filed on Apr. 27, 2021.

(51) Int. Cl.
*A41G 5/02* (2006.01)

(52) U.S. Cl.
CPC ..... *A41G 5/02* (2013.01)

(58) Field of Classification Search
CPC ..... A41G 5/02
See application file for complete search history.

(56) References Cited

U.S. PATENT DOCUMENTS 1,831,801 A 11/1931 Birk
2,421,432 A 6/1947 Phillips
2,503,552 A * 4/1950 Hassler ..... A41G 5/02 206/823
2,835,259 A 5/1958 Goodman
3,245,416 A 4/1966 Aylott
(Continued)

FOREIGN PATENT DOCUMENTS

CN 108783697 A 11/2018
EP 2203079 B1 5/2016
(Continued)

OTHER PUBLICATIONS

Petrie, Edward M., Acrylic Pressure-Sensitive Adhesives (PSAs): A Comprehensive Guide. Special Chem. https://adhesives.specialchem.com/selection-guide/acrylic-pressure-sensitive-adhesives-ingredient-formulation-tips. Jan. 31, 2022 capture viewed through Wayback Machine Internet Archive. (Year: 2022).*
(Continued)

*Primary Examiner* — Jacqueline T Johanas
*Assistant Examiner* — Jennifer P Connell
(74) *Attorney, Agent, or Firm* — Baker Botts L.L.P.

(57) ABSTRACT

A semi-permanent lash extension, applied in segments distributed laterally, includes individual filaments of preselected density, length, and curl radius bonded to or embedded into a substrate. Adhesive may be integral with the substrate, applied to it during or after manufacture, or in multiple layers to secure filaments to the substrates or the assembly to lashes of a wearer. Double-sided tape may do both. A semi-permanent lash extension, applied by a consumer, includes a pre-applied adhesive and provides for quick, easy application.

23 Claims, 22 Drawing Sheets

(56) References Cited

U.S. PATENT DOCUMENTS

| | | | | |
|---|---|---|---|---|
| 6,029,674 | A | 2/2000 | Han | |
| 8,113,218 | B2 | 2/2012 | Nguyen | |
| 8,225,800 | B2 | 7/2012 | Byrne | |
| D667,664 | S | 9/2012 | McCoy | |
| 8,347,896 | B2 | 1/2013 | Liao | |
| 8,596,284 | B2 | 12/2013 | Byrne | |
| 8,657,170 | B2 | 2/2014 | Martinez | |
| 8,881,741 | B1 | 11/2014 | Mattson et al. | |
| 9,149,083 | B1 | 10/2015 | Dinh | |
| 9,185,943 | B2 * | 11/2015 | Merszei | A41G 5/02 |
| 9,326,558 | B2 | 5/2016 | Martins et al. | |
| 9,456,646 | B2 | 10/2016 | Calina | |
| 9,486,025 | B1 | 11/2016 | Dinh | |
| 9,622,527 | B2 | 4/2017 | Nguyen | |
| 9,848,662 | B2 | 12/2017 | Dinh | |
| D814,107 | S | 3/2018 | Lotti | |
| 9,913,506 | B2 | 3/2018 | Hansen et al. | |
| D850,715 | S | 6/2019 | Lotti | |
| D863,679 | S | 10/2019 | Lotti | |
| D867,668 | S | 11/2019 | Lotti | |
| D877,416 | S | 3/2020 | Lotti | |
| 10,638,826 | B2 | 5/2020 | Lotti | |
| D890,430 | S | 7/2020 | Lotti | |
| 10,716,349 | B2 | 7/2020 | Merszei | |
| 10,721,984 | B2 | 7/2020 | Lotti | |
| D895,201 | S | 9/2020 | Lotti | |
| 10,888,133 | B2 | 1/2021 | Merszei | |
| 11,172,749 | B2 | 11/2021 | Lotti | |
| 11,219,260 | B2 | 1/2022 | Lotti | |
| 11,234,472 | B2 | 2/2022 | Lotti | |
| 11,253,020 | B2 | 2/2022 | Lotti | |
| 11,330,856 | B2 | 5/2022 | Lotti | |
| 2002/0047026 | A1 * | 4/2002 | Jourdin | B65D 83/38 222/321.9 |
| 2002/0056465 | A1 * | 5/2002 | Shin | A41G 5/02 132/53 |
| 2007/0272264 | A1 | 11/2007 | Byrne | |
| 2009/0217938 | A1 | 9/2009 | Rabe et al. | |
| 2010/0018542 | A1 | 1/2010 | Konrad | |
| 2010/0043816 | A1 * | 2/2010 | Dix | A41G 5/02 132/201 |
| 2010/0319721 | A1 * | 12/2010 | Pays | A61Q 1/10 132/218 |
| 2011/0079236 | A1 | 4/2011 | Lee | |
| 2012/0318290 | A1 | 12/2012 | Kim | |
| 2013/0255706 | A1 | 10/2013 | Dinh | |
| 2014/0216488 | A1 | 8/2014 | Dinh | |
| 2014/0283861 | A9 | 9/2014 | Dinh | |
| 2015/0351476 | A1 | 12/2015 | Lin | |
| 2016/0219959 | A1 | 8/2016 | Chipman et al. | |
| 2017/0079358 | A1 * | 3/2017 | Dinh | A41G 5/02 |
| 2017/0112264 | A1 | 4/2017 | Park | |
| 2017/0360135 | A1 | 12/2017 | Ahn | |
| 2018/0065779 | A1 | 3/2018 | Chiba | |
| 2018/0242672 | A1 * | 8/2018 | Lotti | A41G 5/02 |
| 2020/0260839 | A1 | 8/2020 | Lotti | |
| 2020/0275718 | A1 | 9/2020 | Sharafatdinova | |
| 2021/0095170 | A1 * | 4/2021 | Lotti | A61K 8/8152 |
| 2021/0100306 | A1 * | 4/2021 | Lotti | A41G 5/02 |
| 2021/0101710 | A1 | 4/2021 | Ahn | |
| 2021/0161265 | A1 | 6/2021 | Lotti | |
| 2022/0047026 | A1 * | 2/2022 | Brennan | A61K 8/678 |
| 2022/0053862 | A1 * | 2/2022 | Ahn | A45D 40/30 |
| 2023/0116465 | A1 | 4/2023 | Guan | |
| 2023/0189912 | A1 * | 6/2023 | Dewey | A41G 5/02 132/201 |

FOREIGN PATENT DOCUMENTS

| | | | | |
|---|---|---|---|---|
| KR | 200371434 | Y1 | 1/2005 | |
| KR | 100747503 | B1 | 8/2007 | |
| KR | 101507695 | B1 * | 4/2015 | A41G 5/02 |
| KR | 102009954 | B1 * | 8/2019 | |
| WO | WO2007115243 | | 10/2007 | |
| WO | WO 2012014891 | A1 | 2/2012 | |
| WO | WO-2022072351 | A1 * | 4/2022 | A41G 5/02 |

OTHER PUBLICATIONS

Dlovlashes. "Everything About Eyelash Adhesives and Lash Extension Glue." https://www.dolvlashes.com/everything-about-eyelash-adhesives-and-lash-extension-glues (Year: 2020).*

Khanjani, Jaber. "Pressure-Sensitive Adhesive Joints" in Adhesives and Adhesive Joints in Industry Applications. Published May 27, 2019. DOI: 10.5772/intechopen.85667 (Year: 2019).*

Clarivate translation of KR-102009954 (Year: 2019).*

Bliss, Joe, "Part 2: The Basics of Pressure Sensitive Adhesive (PSA) Failure", Sep. 15, 2016. https://www.jbc-tech.com/blog/posts/part-2-w-the-basics-of-pressure-sensitive-adhesive-psa-failure/#:-:text=For%20example%2C%20if%2othe%20PSA, mechanically%20pushed %20into%2othe%20surface, 2 pages.

Lash, Hollyren, "How To Make Strip False Eyelashes and Extensions: Hollyren's Method", https://www.youtube.com/watch?v=8nD3WBgLjNE, published Jul. 17, 2017, 3 pages.

* cited by examiner

MODULAR-SEGMENT, TAPE-IN, LASH EXTENSION APPARATUS AND METHODS

RELATED APPLICATIONS

This utility patent application claims the benefit of U.S. Provisional Patent Application Ser. No. 63/180,464, filed on Apr. 27, 2021, and U.S. Provisional Patent Application Ser. No. 63/273,382, filed on Oct. 29, 2021; and U.S. Provisional Patent Application Ser. No. 63/278,366, filed on Nov. 11, 2021, and U.S. Provisional Patent Application Ser. No. 63/305,498, filed on Feb. 1, 2022; all of which are hereby incorporated by this reference in their entireties.

BACKGROUND

1. Field of the Invention

This invention relates to beauty products and, more particularly, to novel systems and methods for artificial extensions to eyelashes.

2. The Background Art

Artificial eyelashes began, as might be expected, in the movie industry. Conventionally, artificial eyelashes relied on an array of fibers secured by a temporary adhesive to an eyelid of a wearer, just above the wearer's natural, upper eyelash. Eventually, the technology moved on to include artificial eyelashes that secured temporarily to the natural eyelashes themselves.

The modern and current status of technology is that highly trained technicians using highly reactive adhesives such as cyanoacrylates may apply individual fibers to individual lashes of a wearer thereby providing a "semi-permanent" extension to each eyelash. Such eyelash extensions require about two to three hours to apply a full set of extensions to both eyelashes. They typically last for about three weeks, although vigorous touching, washing, or exposure to cleansers may weaken the bond of an extension causing it to separate from a natural lash. Also, lashes may fall out, especially as they age, carrying with them any extension attached.

Certain complex, precision processes exist for applying individual extensions. Nevertheless, both the "full set" application and the "individual extension" application have their own limitations. For example, individual, semi-permanent extensions take more time than many potential wearers are willing to invest for installation or application. Of course, the time in training and safety precautions by a technician comes at a cost, as well. Professional artificial lash extensions also require a professional to apply them. The consumer or end user cannot apply the artificial lashes themselves.

What is needed is a method and apparatus to improve comfort, improve longevity, and reduce installation or application time for extensions. It would also be an advance to provide for a degree of artistic shaping of lengths, density (number of filaments per unit distance), or the like. Extensions are distributed along an eyelash of a user, such as from near the medial (center) plane of symmetry of the face toward a lateral or outside edge of the face. For example, near the nose, lashes need to be shorter, and possibly softer, whereas they may be longer near the center or near the outside (lateral) region of the natural lashes.

There are two main categories of artificial eyelashes: semi-permanent eyelash extensions applied by a professional technician; and daily-wear artificial eyelash extensions that can be applied by a consumer, and are applied and removed daily. Typically, daily-wear artificial eyelashes are applied with a temporary adhesive, are difficult to apply, and are generally considered uncomfortable. They may also come off prematurely with moisture, such as sweat, tears, or the like. They are applied as a group with a plurality of artificial lashes attached at the base. These groups of artificial eyelashes, or strips, can be applied with fingers or tweezers by the person wearing them. They typically require about 20 minutes to apply, generally in the morning.

What is needed is a method and apparatus to allow consumers, or end users, to apply artificial lash extensions themselves in a quick and easy manner, and have the artificial eyelashes be able to remain affixed for more than one day, preferably, more than 3-7 days. Such a product may be applied quickly and easily by the consumer, or user, and allow for multi-day wear.

SUMMARY OF THE INVENTION

In view of the foregoing, in accordance with the invention as embodied and broadly described herein, a method and apparatus are disclosed in one embodiment of the present invention as including a group of segments, where each segment represents a certain lateral (side-to-side) group of extensions having a selected density, where density means the number of individual fibers (filaments) per unit distance laterally. For example, one hundred percent density would be one fiber next to another or one filament next to another across the entire width of a full set of extensions. A fifty percent density would be fifty percent spaces and fifty percent fibers or filaments as extensions.

Conventional attempts at a semi-permanent application of a full-coverage extension product in which an array of extensions is applied to a full eyelash causes another entirely unacceptable set of problems. As a temporary arrangement, for a day, such systems may be acceptable. Semi-permanent application means the extensions must remain in place for weeks. This creates maintenance problems and discomfort overcome by the invention.

For example, eyelashes grow at different rates. When a new, natural eyelash begins to grow, its rate of growth per day is substantially higher than that of an older lash. As lashes age, the rate of growth decreases. Thus, bonding anything to adjacent lashes (new and fast-growing type alongside an older and slower growing type) causes marked discomfort for a user. Techniques, apparatus, and materials in accordance with the invention alleviate this problem. A plurality of artificial eyelash fibers may be fixed at the base and then adhered to a group of natural eyelashes, so they are all affixed together. Thus, a group of artificial eyelashes and a group of natural eyelashes may all be adhered together, but still allow for the natural growth of the natural eyelashes, individually and as a group.

In a system and method in accordance with the invention, individual fibers are arranged at a preselected density then bonded together with a substrate, such as a ribbon or tape into which the individual fibers or filaments acting as extensions are embedded, or adhered. An adhesive may be built into the tape or substrate, may be applied after bonding to the filaments or fibers, or both. In certain embodiments, a double-sided tape may adhere by one surface to a structural substrate securing filaments of an extension, while an opposite surface adheres to a natural eyelash. A substrate may have filaments adhered to it by an adhesive or embedded within its base material itself. A double-sided tape may secure to the substrate on the lash side of the substrate, while an opposite face of the tape embeds into itself the natural eyelash to which the extension is applied. In certain embodiments, an artificial eyelash segment may be grouped together and have a base, but initially, have no tape adhesive. One side of such a segment may be dipped in an adhesive, or have an adhesive applied to the appropriate side, or have adhesive applied to both sides.

In one embodiment in accordance with the invention, segments are formed to be a few millimeters wide (laterally). In such an arrangement, three to six segments may correspond to the overall width of an eyelash of a wearer.

In certain embodiments, the segments may be applied to (e.g., placed in contact with) an underside of an eyelash of a user. The substrate is then compressed into place to deform adhesive on the substrate into and among the spaces between individual natural eyelashes. In order to prevent contamination, picking up dust, lint, and so forth, a top liner or cover may be applied on the upper side of the natural lash. In some embodiments, the cover may actually be a substrate of an additional segment of suitable density.

In other embodiments, the cover may simply be a clear or colored portion of the same or similar tape used as a substrate in forming each segment. In some embodiments, the cover layer on the upper side of a natural lash may be offset laterally from segments attached to the lower side of the lash. This tends to smooth out any boundaries between adjacent segments, or blend the seams between adjacent segments so it is not apparent that it was there.

In certain embodiments, where both upper and lower segments are used, the density of each may be considerably less than the density of segments that will only be applied to the underside of an upper eyelash. In this way, selective densities may be manufactured in order that a technician or wearer may select a density that tends to look more natural. If beauty is in the eye of the beholder, according to ancient maxims, the beholder may be close or distant. For a more natural look, additional length is desirable, but density should still be reasonable.

In one currently contemplated method for implementing or applying lash extensions as a series of segments adhered to the natural lashes of a wearer, a process may include selecting single or dual extensions. For example, one may select to apply extensions only to an underside of the natural lashes of a user. Alternatively, one may elect to place dual segments, one above and one below the natural lash. These may be selected to be matched, or one may be offset from another.

In fact, the width of one segment may be either different from or the same as that of one placed on an opposite side (top or bottom) of a natural lash to effect a lateral offset. This will tend to reduce any tendency for a change in slope (e.g., bending at a point where there is no substrate support between segments) later. Typically, if a single set of extensions is applied to the upper eyelashes corresponding to each eye, then a cover strip may be applied, looking something like an eyeliner, on the upper side. Alternatively, other treatments may be used, such as curing, drying, or the like in order to reduce or eliminate adhesive properties of the adhesive on the segment that might extrude between the natural eyelashes.

The process may next select either lengths, or a range of lengths for the individual segments that will be applied to an eyelash. That is, different lengths of filaments or fibers making up the extensions may be applied. Length may even be variable within a segment. Typically, a distribution will actually be selected in which, for example, closer to the nose or the medial aspect of the face, extensions are the shortest. Closer to the center of the natural eyelash, the filaments will typically be longest, while at the outside or lateral aspect of the natural lashes, length reduces to less than that near the center but still greater than the medial extensions. In some embodiments, a user may desire for the longest length to actually be at the lateral extreme (outermost) segment.

A technician may provide a setup or may set up the environment including positioning a wearer in a recumbent position. Necessary trays of segments sit in proximity, for easy access. Typically, it is very useful to have trays labeled as well as presenting a physical distribution of segments within a tray. A technician may then readily work from one side to another in sequence, ordered by the arrangement of the segments on a delivery tray serving up the extensions.

Typically, cleaning will be required in order to remove oils naturally occurring on lashes. For example, various adhesives may not bond in the presence of oils. Oils are ubiquitous on skin, transferring to hair, lashes, eyebrows and so forth. Thus, cleaning may involve using soaps, other cleansers, solvents, or the like to remove oils and other contaminant including dust and the like.

Masking is an optional step in that it provides a clean work area, protection for the eyes themselves, separation or taping down (out of the work space) the lower lashes that are not typically involved in application of extensions, and so forth. Similarly, masking provides a stable space for resting fingers of a technician or hands of a technician in applying extensions. This maintains a clean work area without transferring oils from the face of a subject (wearer) to instruments and hands of a technician.

Proper masking may also stabilize eyelids in a closed configuration. A wearer has an upper eyelid and a lower eyelid. However, masking helps to stabilize the lower eyelid and hold down the lower lash against the lower eyelid. Meanwhile, stabilization of the upper eyelid may assist in fixing the natural lash to aid in the precision of the application of the extension segments.

Application of extensions may begin with removing a backer from adhesive on a segment to be applied, positioning that segment with respect to the natural lash, and contacting that natural lash. Pressure may be applied with the nibs of a tweezer. The tweezer is configured to provide comfortable access by the technician, and a full width application of pressure on the tape or substrate pressed against the natural lash. This process of picking up a segment, removing its backer, positioning it at the proper location, in contacting a natural lash, and applying pressure is repeated for each segment. Applying pressure may be done repeatedly especially at boundaries between segments.

In fact, even if dual extensions are not used, one may overlap slightly the substrates on adjacent segments. In some embodiments, the substrates may actually have a slight gap or clear space to which no extension fiber or filaments are attached. This provides materials for such overlapping. Again, any overlapping on the same side of the lash, or on an opposite side of the natural lash may provide a more consistent shaping or curvature of the overall set of applied lash extensions.

Following application of a full set of extensions (corresponding to one eye), the technician may apply a cover layer. The cover layer may be another set of extensions. Lash always means the natural lash. The material of the extension may or may not be natural. An extension may typically be an artificial fiber, often mono-filament, but may be a natural fiber or hair. Nevertheless, the cover layer applied may be another set of segments constituting an extension set on an opposite (upper) side of a lash. Alternatively, simple strips, such as the material of the tape or substrate used in the segments may also serve, appearing much like eyeliner, or perhaps another set of eyelashes.

Following application of a set of extensions, a technician may brush the lashes and extensions. A round brush, similar to that of a mascara applicator works. It is elongated in a longitudinal direction and has a round cross section orthogonal to its longitudinal direction. Brushing out the extension fibers side to side separates the fibers from one another. Brushing them from near the eyelid away from the eyelid also separates and tends to render uniform the spacing therebetween. Meanwhile, the technician may unmask the user following the completion of application of brushing.

Certain definitions may be helpful, since natural and artificial fibers or filaments may be used in a method and apparatus in accordance with the invention. Likewise, natural lashes, artificial lashes, and lash extensions are all mentioned, militating for precise and consistent vocabulary. Context should be clear for all uses of words or terms, herein, but the following definitions reflect an attempt to define and use terms consistently.

A lash or eyelash is a complete natural eyelash, all such terms being interchangeable. Such a term includes the entire plurality of hairs constituting either an upper eyelash or a lower eyelash naturally occurring in an eyelid of a person.

Hair means natural hair, a lash hair being a single strand of hair in or from an eyelash.

The width of a lash is the length of an arc, along an eyelid (medial to lateral in medical terminology), spanning the lash. Thus, the width extends in a lateral direction across an entire lash itself, measured from a medial end or edge of the eyelash to the lateral end. Medial and lateral are used in their medical sense as being closest to a center plane of symmetry (medial) and outer edge spaced perpendicularly away from the medial plane (lateral), respectively.

A filament or fiber means a single strand of material, whether natural or artificial, whether woven, braided, twisted, or monofilament, intended to simulate an individual lash hair when incorporated into a lash extension system, device, or product.

Natural material is used to identify materials that occur naturally, in nature, and may be harvested and formed without chemical or biological transformations, such as reactions, refining, leaching, and the like. Hair, feathers, down, wood, cotton, and the like are examples of natural materials.

Artificial material, as an expression, means materials manufactured from raw materials and transforming those materials, typically by heating, refining, processing, reacting, polymerization, or the like to create a material not found naturally. It is physically or chemically constituted in use. Plastics, elastomers, and other polymers, including synthetic fibers derived from petroleum are typical of artificial materials.

An extension is a system, device, and method involving securement of filaments to eyelashes resulting in an appearance of additional length, density (number of filaments per unit distance of width along the eyelash), color, curl, or other observable property. Such augmentation of properties of eyelashes is typically based on some perception or intention of beautification.

Semi-permanent, applied to lash extensions or any portion or combination thereof, means remaining operational for multiple days, at least three days, and usually for seven or more days. This applies to solid materials, adhesives, and so forth, in normal use and not when subjected to extraordinary stress (force per unit area), strain (stretch per unit length), solvents, other reactive chemicals, extremes of pH sufficient to contribute to failure, or the like, which may occur due to exposure to unreasonable conditions not normally expected in the course of reasonably careful wearing.

In one embodiment, a method for applying an artificial eyelash to a natural eyelash may include the steps of: cleaning a natural eyelash to remove unwanted dirt and oil; then applying a first adhesive, or a liquid adhesive, to the natural eyelash in a manner that effectively coats the natural eyelash; then allowing the first adhesive to cure and/or become tacky; then applying an artificial eyelash to the underside of the natural eyelash, wherein the artificial eyelash may be described as having a proximate end and a distal end, with the proximate end being the end of the artificial eyelash that would be applied closest to the eyelid of the natural eyelash, and wherein the artificial eyelash may further include a second adhesive, or a pressure-sensitive tape adhesive, which is located near the proximate end and substantially along the length of the proximate end, and wherein the artificial eyelash may include a transverse fiber along the length of the proximate end; and then applying pressure to the artificial eyelash in a manner that mixes the first adhesive and the second adhesive and adheres the artificial eyelash to the natural eyelash.

In one embodiment, the transverse fiber may be located on the opposite side of the artificial lash from the second adhesive. This configuration may also be described as having the second adhesive and the transverse fiber on opposite sides of the artificial lash and along the length of the proximate end. The first adhesive, or liquid adhesive, may be comprised of various components, including styrene/acrylates/ammonium methacrylate copolymer, water, adhesion promoter, acrylate copolymer, and a color component or compound such as carbon black. The second adhesive, or pressure-sensitive tape adhesive, may be a non-Newtonian adhesive fluid. The mixing and activating of the first adhesive and the second adhesive, by applying pressure or some other suitable means, may create a fluid bond between the adhesives, which fluid bond allows the natural eyelash to continue to grow at a normal rate while the artificial eyelash is adhered to, but without uncomfortable bunching, wrinkling, or pinching (sometimes referred to as "creep").

In one embodiment, the artificial eyelash may be packaged in such a manner that the artificial eyelash is removable from the packaging in a manner that allows the second adhesive to become exposed, and ready for application, as the artificial eyelash is removed from the packaging. An artificial eyelash may include a second adhesive that is covered by a backer, or protective film. A backer prevents contamination and curing of the pre-applied adhesive on the artificial eyelash extension. While in the packaging for the artificial eyelash, the artificial eyelash may be positioned so that the backer, or protective film, is relatively securely attached to the packaging. Then, when the artificial eyelash is removed from the packaging, the protective film remains with the packaging and exposes the second adhesive. Thus, the artificial eyelash is prepared for application as soon as it is removed from the packaging. There is no need to apply any other adhesive to the artificial eyelash because the second adhesive, as one example a pressure-sensitive adhesive, is already on the artificial eyelash. In other words, the artificial eyelash is sold to a user in a manner that allows the user to apply the artificial eyelash to their natural eyelashes without the assistance of a technician, and without additional chemicals, preparation materials, special tools, or the like.

In one embodiment, the process of method for adhering an artificial eyelash to a natural eyelash may be completed within approximately minutes, and even within sixty (60) seconds. Also, the artificial eyelash may stay or remain adhered or affixed to the natural eyelash for multiple days, at least three (3) days, and even from about 7-14 days.

The process or method for adhering an artificial eyelash to a natural eyelash may be repeated in a substantially similar manner so that artificial eyelashes may be applied to both the underside and topside of a natural eyelash. Such a "sandwiched" configuration may allow the artificial eyelashes to remain adhered or affixed to the natural eyelashes for approximately 14-28 days.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE ILLUSTRATED EMBODIMENTS

Figure 1:
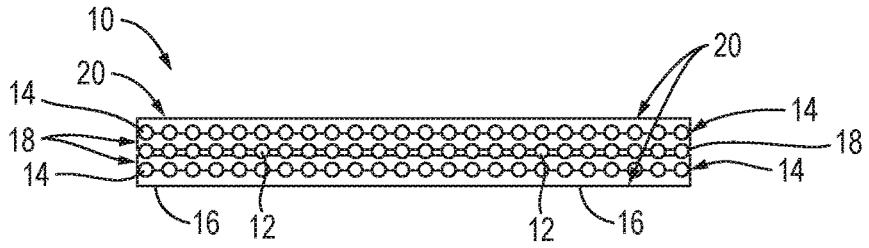
FIG. 1 is an end, cross-sectional view of one embodiment of an installed or applied system of lash extensions, illustrated schematically in a dual top (and bottom) application configuration.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, but is merely representative of various embodiments of the invention. The illustrated embodiments of the invention will be best understood by reference to the drawings, wherein like parts are designated by like numerals throughout.

Referring to FIGS. 1 through 4, a schematic diagram of a system 10 or a lash extension 10 illustrates a natural lash 12 (hereinafter always referred to as a lash), and a series of fibers 14 or extensions, also sometimes referred to as filaments 14. In general, a single extension 14 may be a single fiber or a single filament of a natural or artificial material. Hereinafter, a fiber 14, filament 14, or the like will always refer to the material 14 or the device 14 that operates as an individual substitute for a natural lash hair in a system 10 such as the extensions set 10.

The word "extension" may be used to refer to both an entire set 10 or an individual fiber 14. Context should make it clear. In the illustrated embodiment, the system 10 or extension 10 relies on a substrate 16 such as a band 16 or tape 16. This substrate 16 may be film, may be a polymer, and may at different stages be, for example, an uncured polymer, a B-staged polymer where it is partially cured, or may be a fully cured and therefore mechanically stable polymer. This substrate may be any type of pre-applied adhesive suitable for the intended purpose.

In the illustrated embodiment of FIG. 1, two bands 16 are used, each holding a series of fibers 14 aligned substantially in parallel and bonded to the natural lash 12 by an adhesive 18. In some embodiments, the band 16 may have an adhesive 18 applied, at the time of manufacture, or applied at the time of application (installation) to the lashes 12 of a subject (wearer).

In the illustrated embodiment of FIG. 1, the upper band 16, or the upper one of the two bands 16 is adhered above the natural lash 12. Accordingly, it acts as a cover 20. In other embodiments, a band 16 may be applied as a cover 20 with no additional fibers contributed by its presence. In such an embodiment, the cover 20 becomes something of an eyeliner layer 20 that may be colored to match the color of the fibers 14 or simply be a dark color to match any desired color.

In one embodiment, a synthetic eyelash system 10 may consist of distinct upper and lower segments of lashes. Each segment may have specific characteristics. Any segment may implement an adhesive tape 16 in a specific, prescribed manner. An adhesive tape 16 may be considered as double-sided tape. An adhesive tape may be comprised of poly methyl methacrylate, and may include other compounds. An adhesive 18 that thickens may be used, and an adhesive may be non-Newtonian. In one embodiment, an adhesive may be absent and replaced with a heat fusion process.

Figure 2:
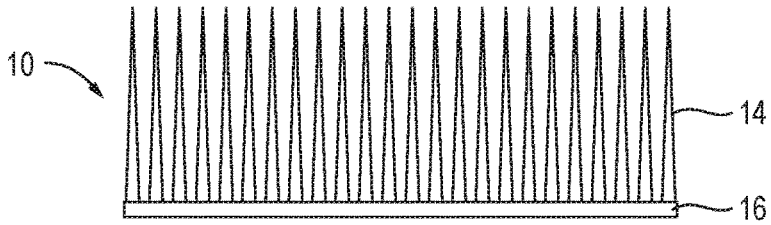
FIG. 2 is a top elevation view of the schematic extension installation of FIG. 1.
Figure 3:
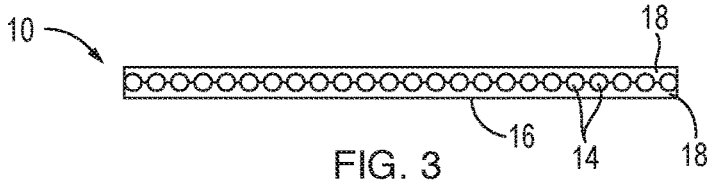
FIG. 3 is an end elevation view of a single extension set on its substrate.

Referring to FIGS. 2 and 3, a single band 16 is formed, holding a series of fibers 14 or filaments 14, which filaments 14 may be tapered locally (distal end), or along their entire length. In one currently contemplated embodiment, the individual filaments 14 or fibers 14 may be tapered only near their distal ends, where the distal end is farthest from the subject. The proximal end is closest to the subject and held by the band 16.

Typically, the band 16 in such an embodiment is on the lower extremum of each filament 14. Thus, adhesive 18 is applied on an upper extremum. As a matter of fact, the band 16 may be melted, injected, or otherwise cured to not only fit below the filaments 14 but to surround them. An adhesive layer 18 may be added to the band 16 at or before the time of application of the system 10 to a user.

Figure 4:
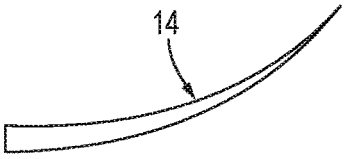
FIG. 4 is a side elevation view of the schematic extension set of FIGS. 2 and 3.

Referring to FIG. 4, the concept of a tapered filament 14 is illustrated schematically. As a practical matter, eyelashes 12 are typically tapered at their distal end as a natural result of their emerging at a smaller diameter than their eventual mature diameter. Nevertheless, lashes 12 naturally grow like hair at a single thickness along the majority of their length. Therefore, the concept of a taper that is continuous along the entire length of a filament 14 may exist, but it is not necessary. However, tapering the distal ends or tips of the filaments 14 provides a much more natural look to the filaments 14 once applied.

Figure 5:
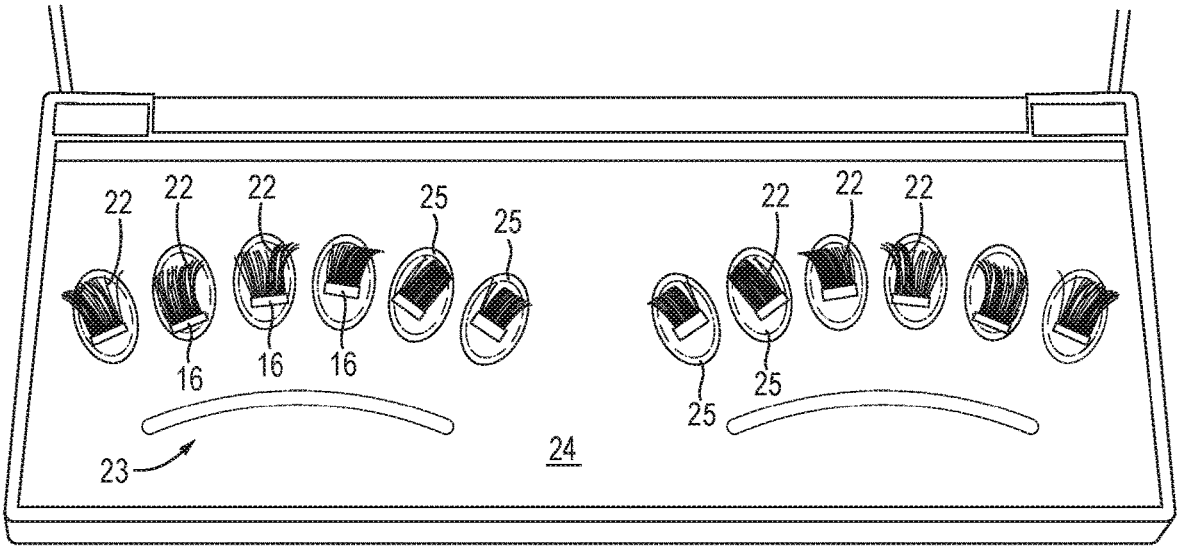
FIG. 5 is an illustration of one embodiment of an uninstalled set of extensions showing the individual segments thereof suitable for application to both right and left lashes of a wearer, and illustrating variations in length of the extensions along the arc of a natural lash of a wearer.

Referring to FIG. 5, while continuing to refer generally to FIGS. 1 through 25, a system 10 or extensions 10 will typically be applied as segments 22. A series 23 of segments 22 will constitute a set 23. When completely applied to the natural lashes 12 of a subject a set 23 of segments 22 constitute a system 10 of extensions 10. That is, a full set 23, once applied, becomes a system 10 or a full extension 10.

In the illustrated embodiment, a tray 24 or case 24 is provided with stations 25 as depressions 25 or indentations 25 within a material as holders 25 for the different segments 22 to be used in an application. One will note that the density (the number of filaments 14 or fibers 14 per unit of width) along the band 16 of each segment 22 is comparatively sparse. Typically, the overall density desired is somewhat more dense than the natural lashes 12. However, each filament 14 typically has a somewhat greater diameter than that of a natural lash 12. Length is substantially longer than that of a natural lash 12. That's why "extensions" exist.

In the illustrated embodiment, the band 16 on each segment 22 is covered with a backer 21 protecting the adhesive 18 on the band 16 against contamination, or against other contact. The backer 21 will eventually be removed by a technician before contacting a subject's natural lash 12 by the adhesive 18 on a band 16 of a segment 22. The band 16 may ultimately be used to refer to the entire continuous expanse of individual bands 16 for each segment 22 once applied to natural lashes 12.

Figure 6:
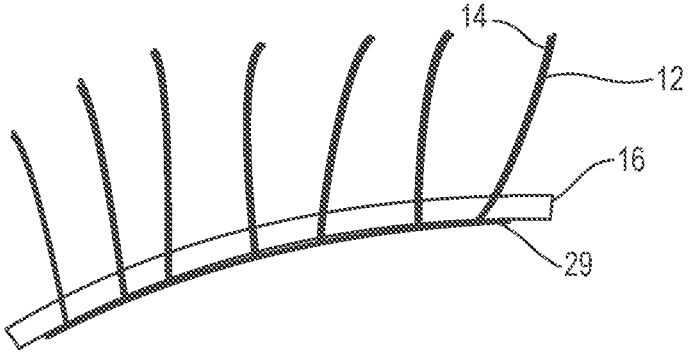
FIG. 6 is a schematic diagram of a newly installed set of extensions on a natural lash extending from an eyelid of a wearer.

Referring to FIG. 6, at the time of installation or application, the band 16 will be comparatively close (within a millimeter or two) to the eyelid 29 of a subject. Thus, a short distance or length of the natural lashes 12 will proceed from the eyelid 29 outward toward a distal end. The band 16 of a segment 22 will be secured to several natural lashes 12, and preferably on the underside of the lash 12 first. That is, doubling up in a dual extension 10 is not necessary, although it may be used in some situations. Regardless of the mode of application, as single or dual segments 22 and extensions 10, the filaments 14 or fibers 14 extend from the band 16 away from the eyelid 29.

Figure 7:
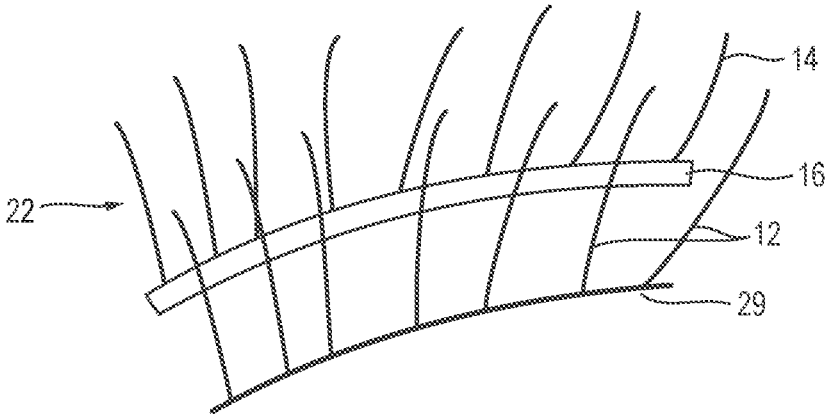
FIG. 7 is a schematic diagram of the same, installed, set of extensions after an extended wear, such as two or three weeks after installation.

Referring to FIG. 7, some weeks later, given the growth of the natural lashes 12, the band 16 moves away from the eyelid 29. In the illustrated schematic, the band 16 at some point will therefore be removed and replaced with a new set of segments 22 against the lashes 12 as illustrated schematically in FIG. 6.

An additional mechanism is found useful in the adhesive 18. If the adhesive 18 is excessively rigid, then adjacent lashes 12, growing at different rates (distance or length per unit of elapsed time) may cause tension or compression by lashes 12 against the eyelid 29. It has been found preferable to use a rheological material such as a rheological adhesive 18 in order to permit a certain amount of creep (permanent deformation of molecules) or even yielding (permanent displacement of atoms) of the adhesive over time.

By rheological material is meant a non-Newtonian material. Newtonian fluids operate according to conventional rules of viscosity. A fluid, whether gas, saturated vapor, or liquid is defined in the art of fluid mechanics as a material that will move under any amount of stress. How fast such a fluid will respond to shear stress is measured in terms of viscosity. A more viscous material (e.g., honey, heavy oils, etc.) will have a different response from that of a thinner, less viscous, or more inviscid liquid (e.g., water, alcohol, etc.).

A rheological material may act like a solid, but flow as a non-Newtonian fluid under sufficient stress or prolonged stress.

For example, rheological materials may operate as solids under a certain amount of stress (where stress is a force per unit of area, whether tension, compression, or shear), but operate as a fluid or somewhat like a fluid under a higher stress. Various varieties of these non-Newtonian materials that can operate as both solids and fluids may involve highly viscous materials, may involve fillers that tend to stabilize a fluid, or may involve Bingham plastics.

A Bingham plastic is a material that does not move under some predetermined amount of stress, but then begins to flow once that level of stress is exceeded. A filled Bingham plastic may respond to stress by distorting, and even releasing and readhering to a lash 12. Thus, comfort is greatly increased by using a rheological material as the adhesive 18. In this way, materials may be used as adhesives 18 that accommodate the differential growth rates between newer and older natural lashes 12 captured by a single segment 22.

In addition, the fact that segments 22 need not contact one another, provides for more natural movement of the filaments 14. This provides a decoupling of stresses between different, neighboring, natural lashes 12 emerging from an eyelid 29.

Figure 8:
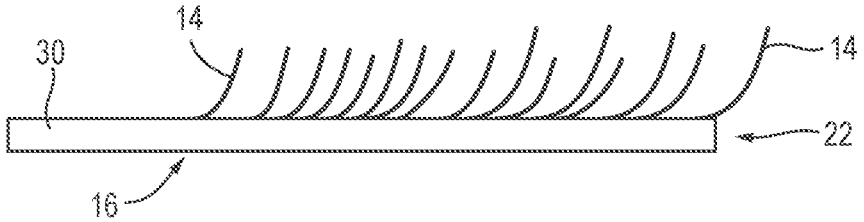
FIG. 8 is a schematic diagram of one embodiment of an end segment (at one lateral end or the other of a set of lash extensions), showing an edge fold suitable for lateral stabilization.
Figure 9:
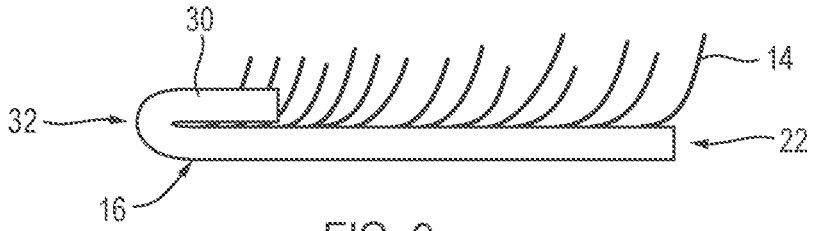
FIG. 9 is a schematic, end elevation view of the extensions in one segment, having the edge fold folded into place to provide lateral support for extension fibers, suitable as the last segment at a lateral edge of an installed set of segments.

Referring to FIGS. 8 and 9, in certain embodiments, it has been found that filaments 14 on edge segments 22 may lose filaments 14. Those nearest the medial plane of the face (closest to the nose) and nearest to the lateral aspect of the face (outboard edge of the natural lashes 12) need lateral support. Side-to-side throughout the main body of a system 10, various fibers 14 or filaments 14 have each other, the intervening band 16 and adhesive 18 to keep them in place. Little lateral support is available to the last fibers 14 on each edge. Thus, fibers 14 may shed from near the ends of the combined overall band 16 of a system 10.

Accordingly, in the illustrated embodiment of FIGS. 8 and 9, a fold 30 or edging 30 may extend beyond the individual filaments 14 extending from the base 16 or band 16 of an individual segment 22. Thus, the lateral-most or the edge segments 22 may have their band 16 extended as an edge 30 or fold 30. The fold 30 may then be doubled back over to form a lateral stabilizer 32 in the segment 22.

Figure 10:
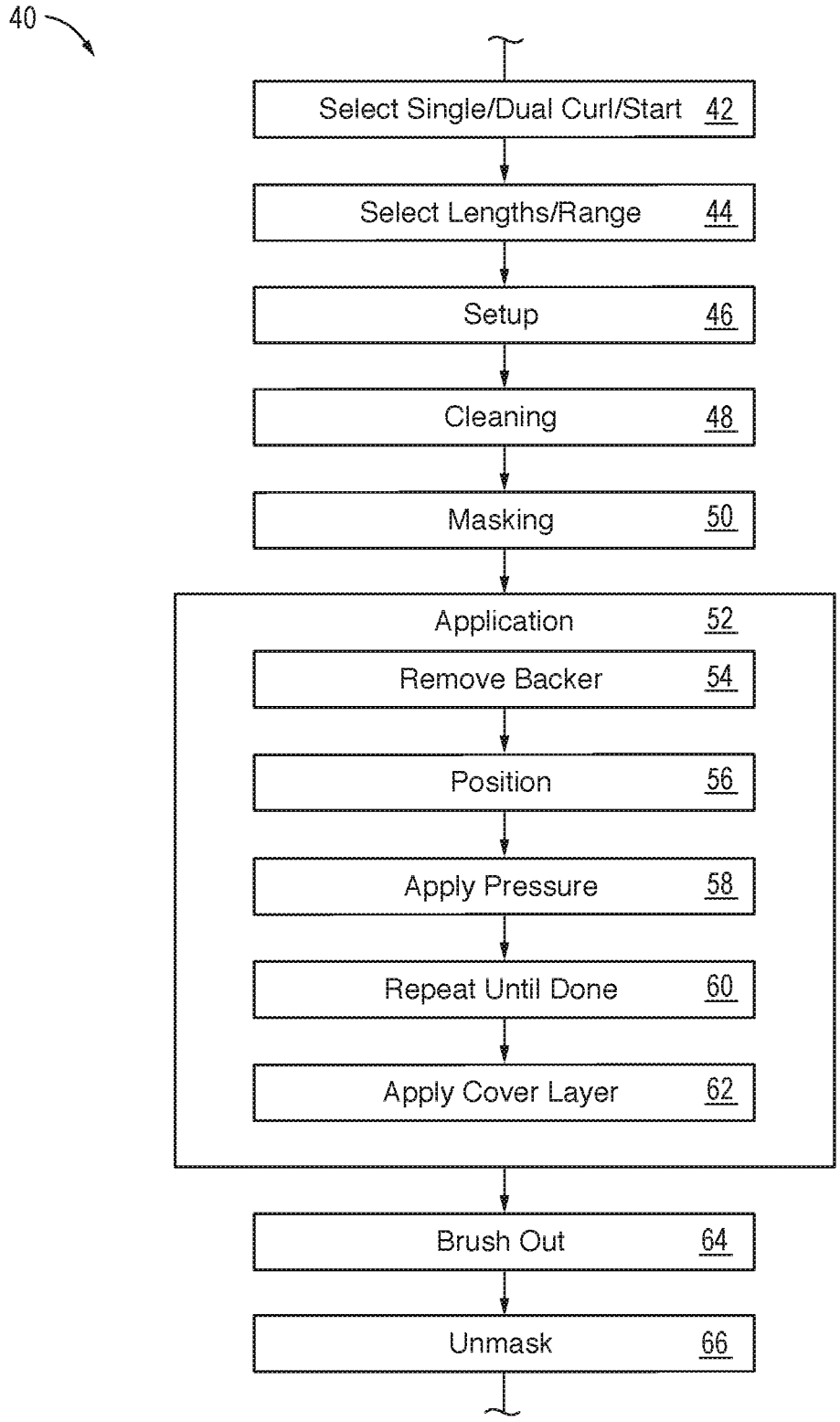
FIG. 10 is a schematic block diagram of one embodiment of a process for installation of a set of extension segments for a wearer.

Referring to FIG. 10, a process 40 in accordance with the invention may involve selecting a form or style of extension 10. For example, single extensions 10 may simply adhere to the underside of the natural lash 12 of a wearer. Dual systems 10 may bond segments 22 both below and above the natural lash 12. Likewise, the amount of curl or the arc radius of curling, as well as the location at which it begins may be selected. For example, a particular radius of curl may be desirable, and may begin at the band 16. Alternatively, curl may actually begin near a distal end. The filaments 14 or fibers 14 may actually be straight at the band 16. Moreover, the radius of curl may be designed into a set of fibers 14 in a segment 22 to be long and sweeping or short and opening quickly with distance away from the eyelid, toward the distal end of the fibers 14.

A technician, typically in consultation with a subject (wearer) will typically select a length or a range of lengths to be used for the fibers 14 in individual segments 22. Segments 22 may typically be from about three to about seven in number to form one system 10 corresponding to a single eye. It has been found that a group of about six segments 22 covering a distance of about a few dozen millimeters or a few centimeters will typically accommodate the lash 12 of one eye or corresponding to one eye.

In a method 40 in accordance with the invention, the example of FIG. 5 shows a variety of lengths. They range from nine millimeters closest to the medial plane of the face to twelve millimeters near the center of the extension 10. The outer segments 22 have a length of about ten millimeters in that embodiment.

A setup 46 by a technician may involve an arrangement of the subject in a comfortable, typically recumbent, position. The head and neck are properly supported to stabilize the face. Stability aids precision and easy access by the technician and comfort of the subject. Likewise, providing the selection of segments 22 at the proper lengths, according to the selections 42, 44 and arranging them in a tray 24 close at hand for easy access by the technician. Similarly, adhesives 18 may need to be provided for in the tray 24, although the illustrated embodiment contemplates an adhesive 18 previously applied to the band 16 of each segment 22, and covered with a backer 21 that may be removed with or without tools.

Typically, cleaning 48 will be required in order to remove oils naturally occurring on lashes. For example, various adhesives may not bond in the presence of oils. Oils are ubiquitous on skin, transferring to hair, lashes, eyebrows and so forth. Thus, cleaning may involve using soaps, other cleansers, solvents, or the like to remove oils and other contaminant including dust and the like.

Masking 50 is an optional step in that it provides a clean work area, protection for the eyes themselves, separation or taping down (out of the work space) the lower lashes that are not typically involved in application of extensions, and so forth. Similarly, masking provides a stable space for resting fingers of a technician or hands of a technician in applying extensions. This maintains a clean work area without transferring oils from the face of a subject (wearer) to instruments and hands of a technician.

Proper masking may also stabilize eyelids in a closed configuration. A wearer has an upper eyelid and a lower eyelid. However, masking helps to stabilize the lower eyelid and hold down the lower lash against the lower eyelid. Meanwhile, stabilization of the upper eyelid may assist in fixing the natural lash to aid in the precision of the application of the extension segments.

Application 52 of extensions may begin with removing a backer from adhesive on a segment to be applied (step 54), positioning that segment with respect to the natural lash (step 56), and contacting that natural lash. Pressure may be applied with the nibs of a tweezer (step 58). The tweezer is configured to provide comfortable access by the technician, and a full width application of pressure on the tape or substrate pressed against the natural lash. This process of picking up a segment, removing its backer, positioning it at the proper location, in contacting a natural lash, and applying pressure is repeated for each segment (step 60). Applying pressure may be done repeatedly especially at boundaries between segments.

In fact, even if dual extensions are not used, one may overlap slightly the substrates on adjacent segments. In some embodiments, the substrates may actually have a slight gap or clear space to which no extension fiber or filaments are attached. This provides materials for such overlapping. Again, any overlapping on the same side of the lash, or on an opposite side of the natural lash may provide a more consistent shaping or curvature of the overall set of applied lash extensions.

Following application of a full set of extensions (corresponding to one eye), the technician may apply a cover layer (step 62). The cover layer may be another set of extensions. Lash always means the natural lash. The material of the extension may or may not be natural. An extension may typically be an artificial fiber, often mono-filament, but may be a natural fiber or hair. Nevertheless, the cover layer applied may be another set of segments constituting an extension set on an opposite (upper) side of a lash. Alternatively, simple strips, such as the material of the tape or substrate used in the segments may also serve, appearing much like eyeliner, or perhaps another set of eyelashes.

Following application of a set of extensions, a technician may brush the lashes and extensions (step 64). A round brush, similar to that of a mascara applicator works. It is elongated in a longitudinal direction and has a round cross section orthogonal to its longitudinal direction. Brushing out the extension fibers side to side separates the fibers from one another. Brushing them from near the eyelid away from the eyelid also separates and tends to render uniform the spacing therebetween. Meanwhile, the technician may unmask the user following the completion of application of brushing (step 66).

Figure 11:
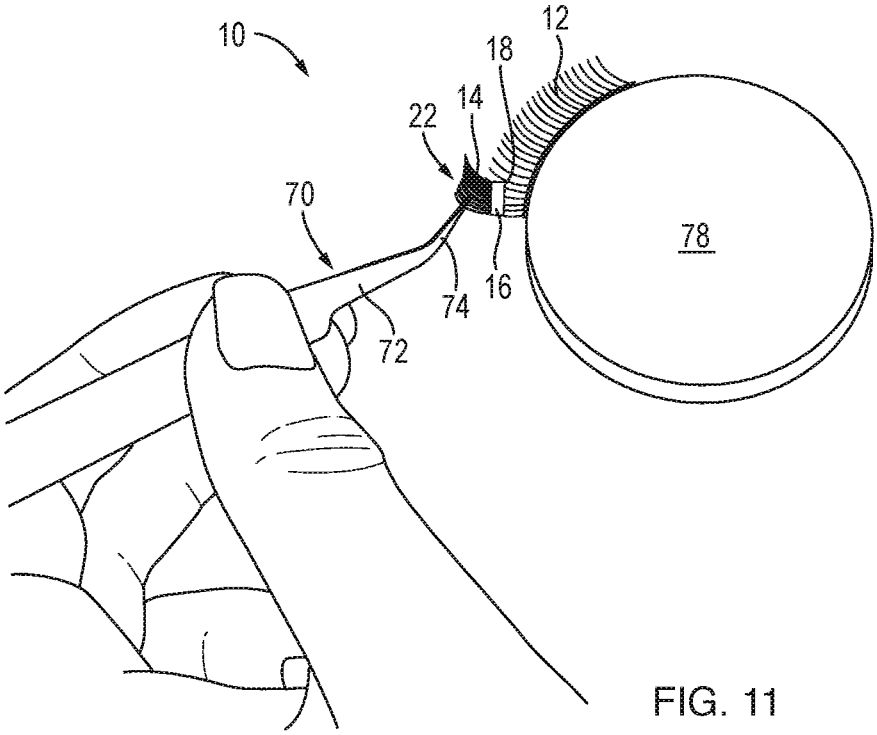
FIG. 11 is an illustration of a training template with a model of "natural" lashes for training a technician to install lash segments of an extension system in accordance with the invention.

Referring to FIG. 11, while continuing to refer generally to FIGS. 1 through 25, a tweezer 70 or forcep 70 may be used, typically made of a handle 72 or handle portion 72 and terminating in nibs 74 at a distal end thereof. Typically, at a proximal end, the handle 72 may be comprised of a bend that operates as a spring. Alternatively, the handle 72 may be made in two pieces bonded together at a proximal end and bent in such a curvature that they are by default open at the nibs 74 at a distal end.

The illustrated embodiment illustrates a training template 78 having simulated natural lashes 12 to which a set 23 of segments 22 may be attached in training. The nibs 74 may hold, manipulate, and otherwise move the segment 22 into contact with the lash 12. The adhesive 18 on the band 16 or strip 16 adheres against the lash 12. Typically, if a single set 23 is to be attached to the lash 12, then the segments 22 will typically adhere to the underside of the natural lash 12.

A cover 20 may adhere opposite the band 16 and adhesive 18. Alternatively, another segment 22 (a dual) having downward facing adhesive 18 may be the cover 20. Another band 16, absent any filaments may be applied as a cover 20 to protect any adhesive 18 exposed between the natural lashes 12. A material to neutralize the adhesive may be painted on, dusted on, or simply result from curing or reacting with the adhesive to form a stable skin thereon.

Figure 12:
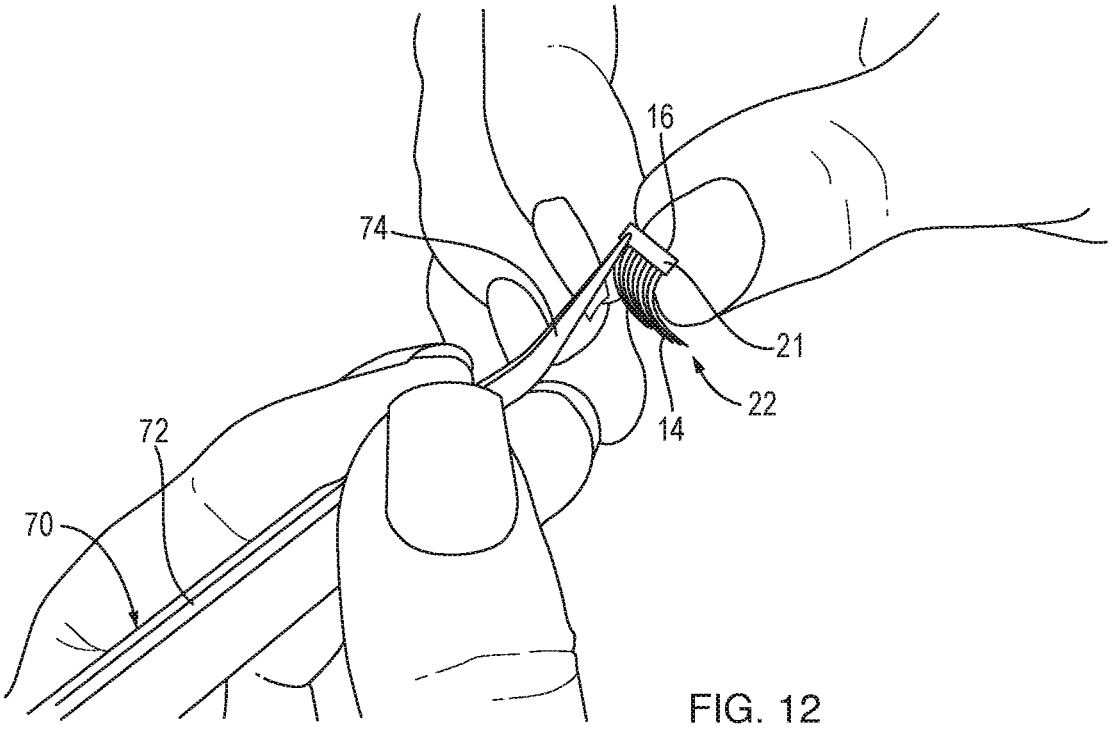
FIG. 12 is an illustration of a technician removing backing material such as a backer paper from a segment of extension fibers, using a tweezer or forcep having a handle portion and nibs portion.

Referring to FIG. 12, while continuing to refer generally to FIGS. 1 through 25, the segment 22 of filaments 14 or fibers 14 may be held temporarily in the fingers of a technician in order to expose the backer 21 protecting the adhesive 18. The distal end of the nibs 74 may be used to capture the backer 21 and peel it away from the adhesive 18 on the band 16 of the segment 22.

Figure 13:
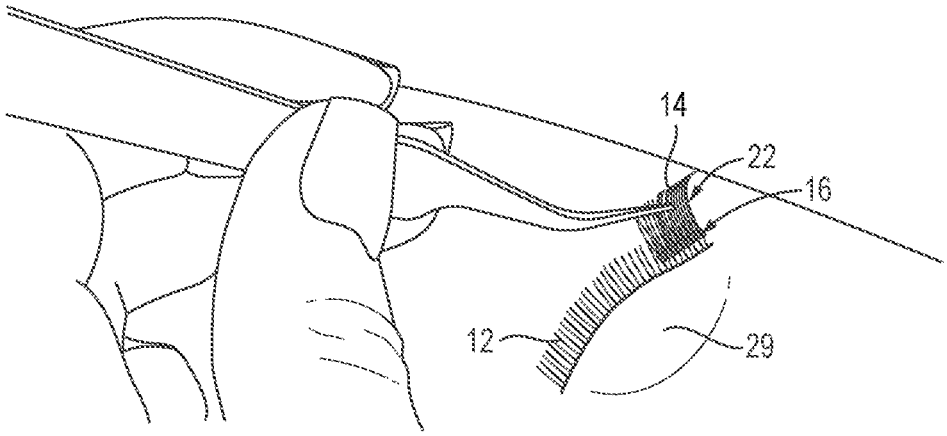
FIG. 13 is an illustration of installation or application of a segment of extension fibers to a simulated natural eyelash on a training mannequin.
Figure 14:
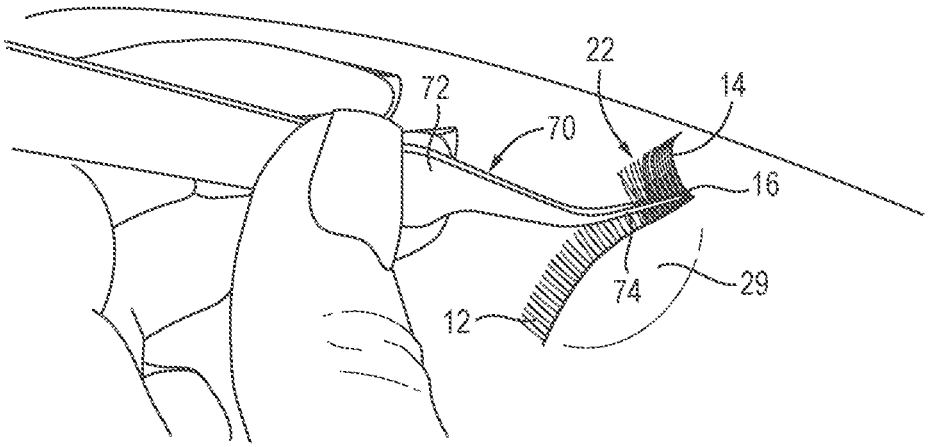
FIG. 14 is an illustration of pressuring or clamping the extension segment in order to deform the adhesive thereon around the natural lash, simulated on a mannequin.

Referring to FIG. 13, the step of moving a segment 22 into contact with the lash 12 by the adhesive 18 on a band 16 is illustrated. Meanwhile, in subsequent steps, FIG. 14 illustrates the application of pressure between the nibs 74 to deform the adhesive, causing it to fill in between and around the lashes 12. The band 16 is consequently bonded with its filaments 14 as a segment 22. The distance between the nibs 74 may be reduced to approach zero by closing the handles 72. Due to being nearly parallel, the nibs 74 may apply pressure along the entire length of the band 16 of a segment 22, thereby embedding the lashes 12 thereagainst into the adhesive 18 on the strip 16.

Figure 15:
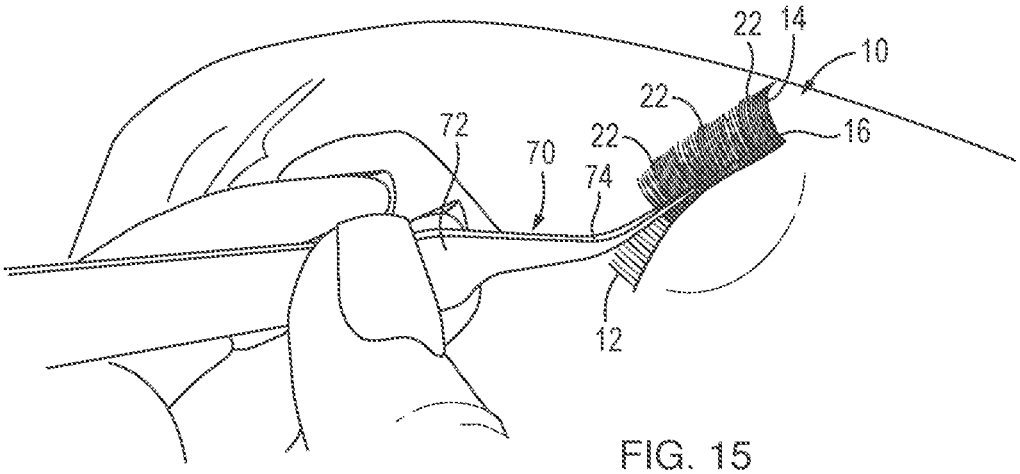
FIG. 15 is an illustration of a later application of a subsequent extension segment on the training mannequin of FIGS. 13 and 14.

Referring to FIG. 15, after several segments 22 have been applied to the natural lash 12, a technician may return and apply pressure to previously applied bands 16 of segments 22. This may be particularly effective at locations where adjacent bands 16 may abut one another, corresponding to adjacent segments 22. In one alternative embodiment, a band 16 may extend laterally slightly beyond the filaments 14 held thereon. This provides a slight overlap between adjacent bands 16.

Figure 16:
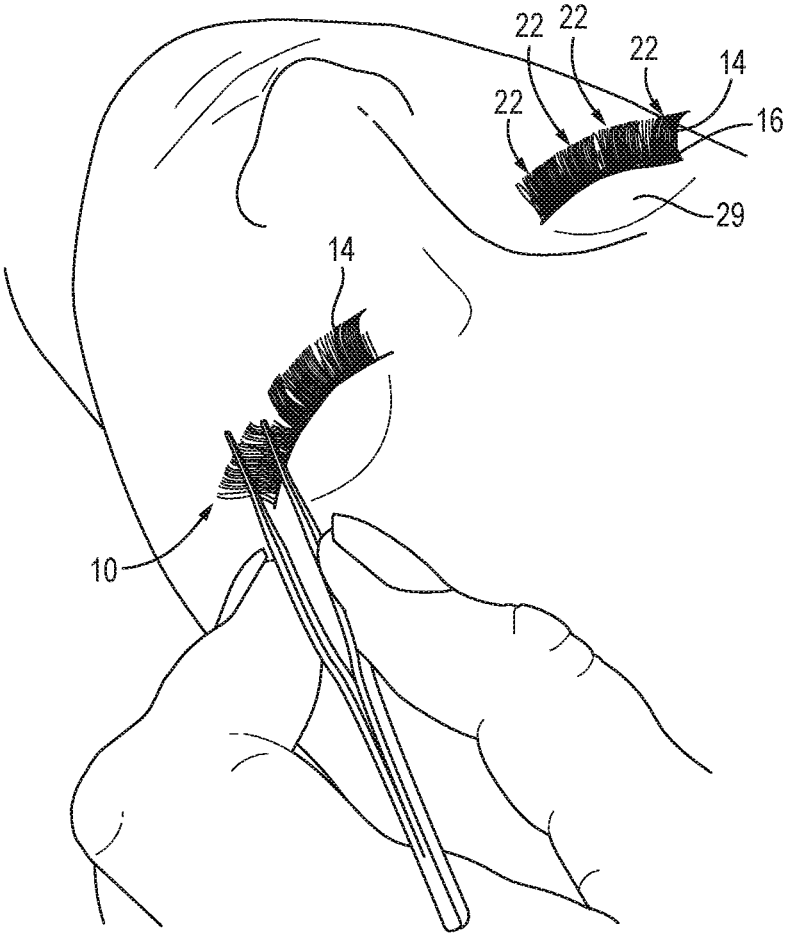
FIG. 16 is an illustration of brushing out an installed or applied set of extension segments in order to affirmatively separate and fluff the extension fibers.

Referring to FIG. 16, following installation of a system 10 in accordance with the invention, a technician may brush the individual filaments 14 by drawing a tweezer 70 laterally over the filaments 14 in order to separate them. This tends to "even up" the spacing between individual fibers 14.

Figure 17:
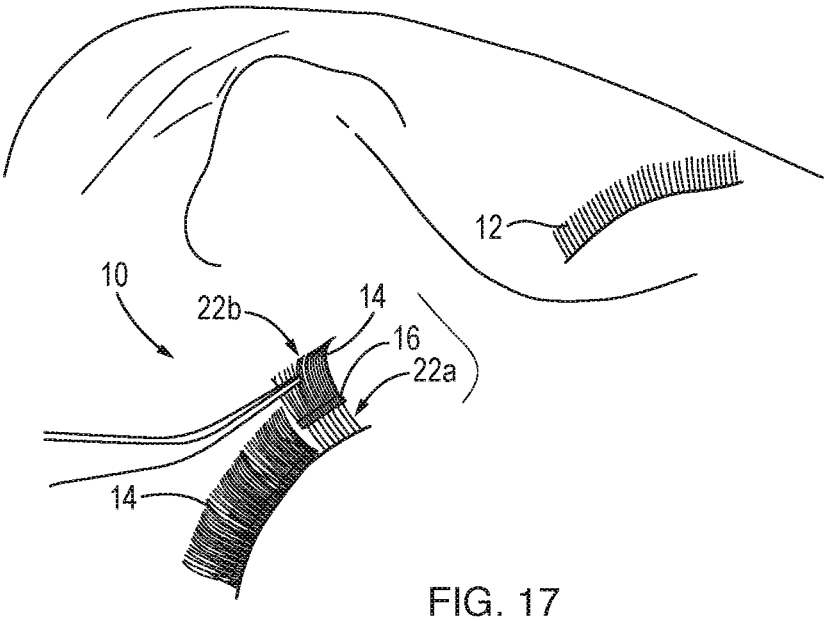
FIG. 17 is an illustration of an optional process of installing an upper extension set, this showing application of a single segment being applied to the top of simulated eyelashes that have already received a set of segments on the underside of the simulated lash.

Referring to FIG. 17, following application of a system 10, an additional segment 22 or additional segments 22 may be applied to the upper surface of the original system 10 or extension system 10 thereby doubling the number of filaments 14. In this regard, one reason why density may be controlled is to render extensions 10 more natural in appearance.

Most lashes 12 are enhanced, made to appear thicker, longer, and darker than natural lashes 12. These properties are effected by the length, diameter, color, density, and so forth of the fibers 14 in each segment 22. By the same token, in order to not overwhelm the appearance of the eyes, the density of extensions 10 may be substantially reduced. This is particularly so for the density of individual segments 22 in a "dual" application. Segments 22 are applied in such a dual configuration as under segments 22*a* and over segments 22*b* illustrated in FIG. 17.

Figure 18:
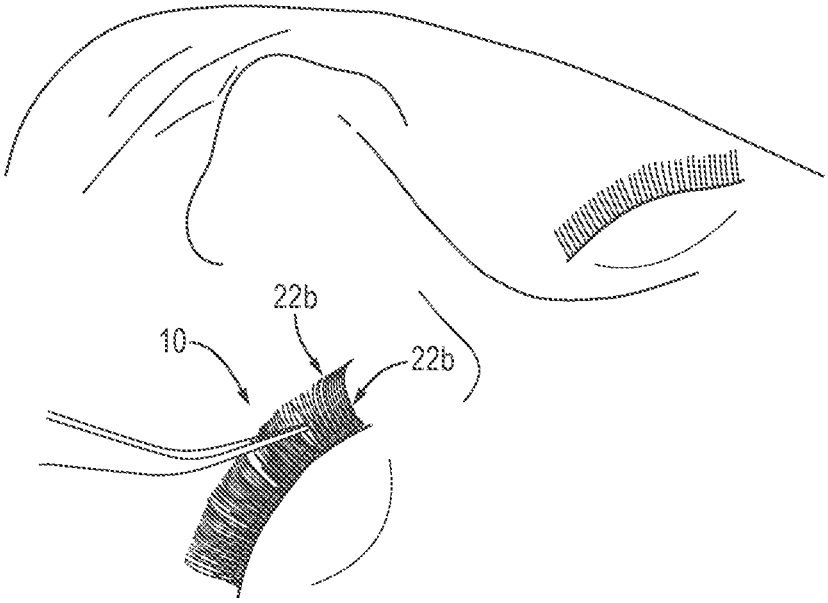
FIG. 18 is an illustration of the clamping process applying pressure to the upper and lower segments attached to the simulated lashes of the mannequin.

Referring to FIG. 18, individual segments 22 require compression or pressure to be applied in order to embed the natural lashes 12 within the adhesive 18 of a band 16 of a segment 22. When dual extensions 10 are applied as segments 22*a*, 22*b* capturing a natural lash 12 therebetween, densities may be selected to be particularly sparse. This tends to relieve an otherwise overwhelming opacity of the extensions 10.

Figure 19:
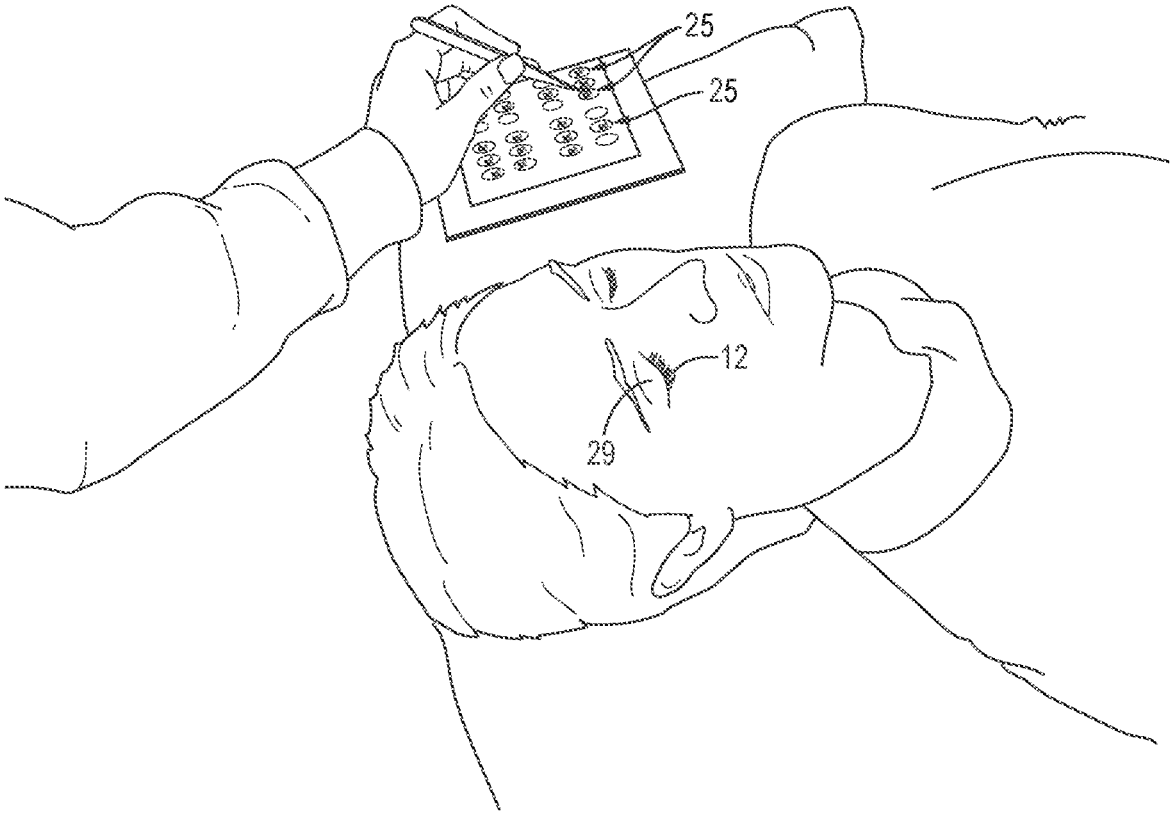
FIG. 19 is an illustration of a live subject in preparation to receive a set of extension segments on natural eyelashes.

Referring to FIG. 19, a subject is in preparation for applying extension segments 22 to natural eyelashes 12. The subject occupies a restful, recumbent position with the head and neck fully supported at the proper orientation. The lashes 12 of the subject are thereby more readily and conveniently accessible.

Figure 20:
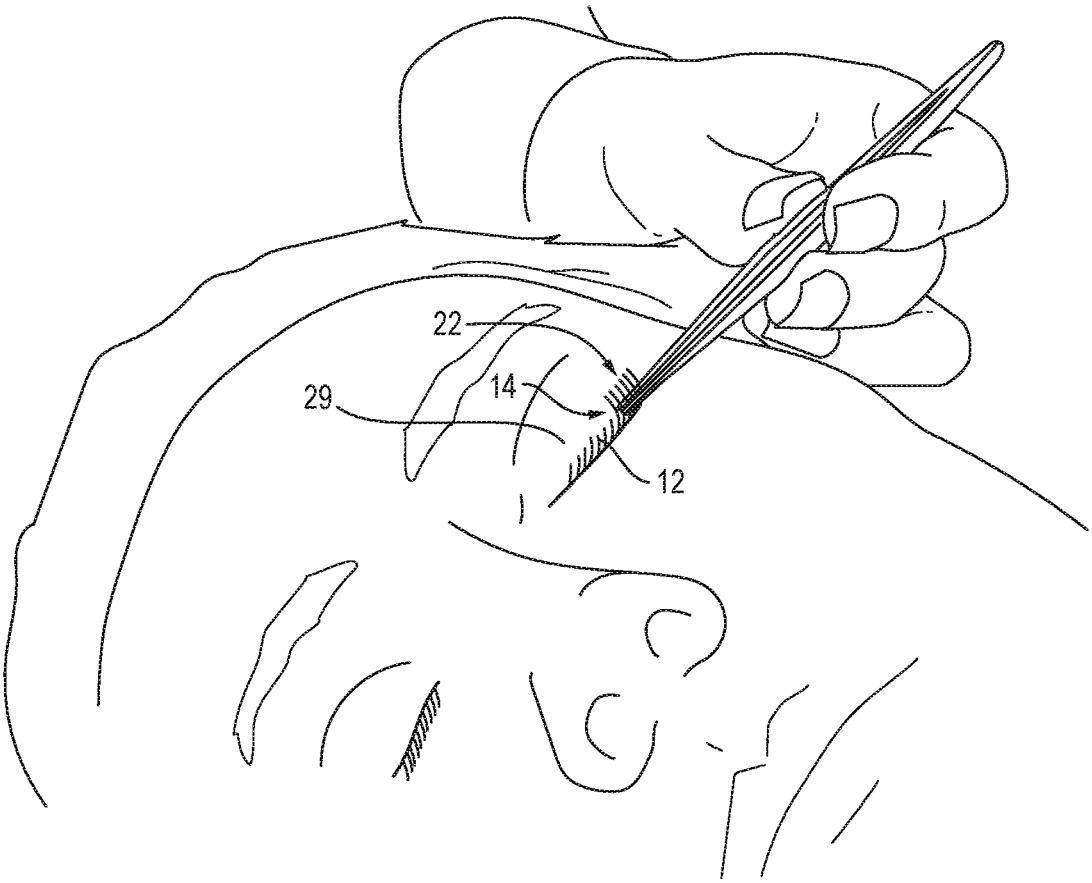
FIG. 20 is an illustration of a technician's hands using the nibs of application tweezers to urge adhesive on a band (strip, substrate, tape) of a segment to adhere by distortion and flow around the natural eyelashes.

Referring to FIG. 20, in an unmasked or non-masked application, conventional chemical substances used require exceeding care and training. Here, adhesives need not be the highly adherent, rapidly setting cyanoacrylates typical of individually applied fibers 14 of conventional extensions. Adhesives may be pre applied to a segment 22. They may be thixotropic or at least much more stable and resistant to dripping. The danger to eyes is minimized. Likewise, because the adhesive is cohesive with itself, injury to eyes and eyelids is not problematic in a system 10 in accordance with the invention. In the illustration, a segment 22 is being applied to a natural lash 12 that is sufficiently sparse to be almost invisible.

Figure 21:
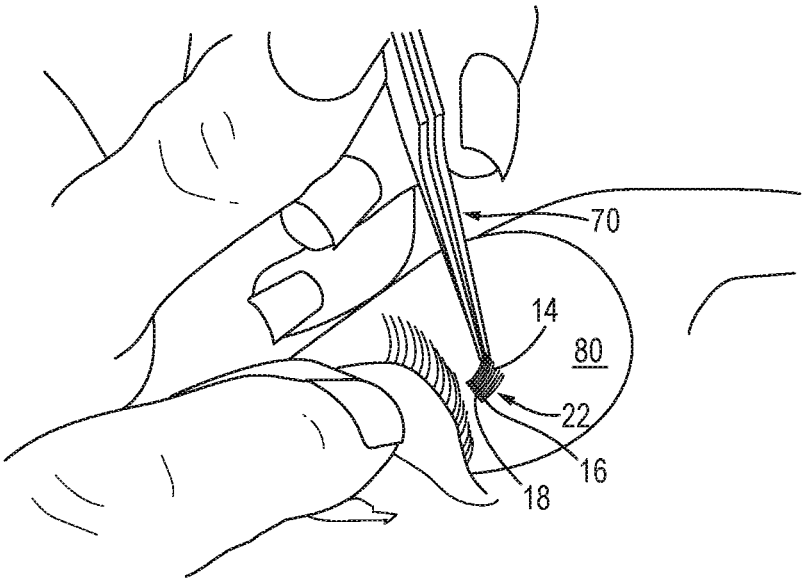
FIG. 21 is an illustration of a subject masked in order to stabilize the eyelids and separate lower lashes from upper lashes to simplify application of a segment of an extension set under a natural eyelash of the wearer.

Referring to FIG. 21, in one currently contemplated embodiment of a system 10 and method 40 in accordance with the invention, a mask 80 effectively tapes down against the lower eyelid the lower lash. The upper lash 12 is exposed and easily accessible. In this arrangement, a technician may accidentally touch the band 16 against the mask 80, without danger of contaminating or neutralizing the adhesive 18, nor transferring facial oils on any part of the segment 22. In this illustration, the segment 22 is being brought up into contact with the underside of the natural lash 12. It is unnecessary, partially due to the masking 80, to have the wearer (subject) open the eyelid. The technician can properly orient the lashes 12 for easy access and contact by the band 16 and adhesive 18 of the segment 22.

Figure 22:
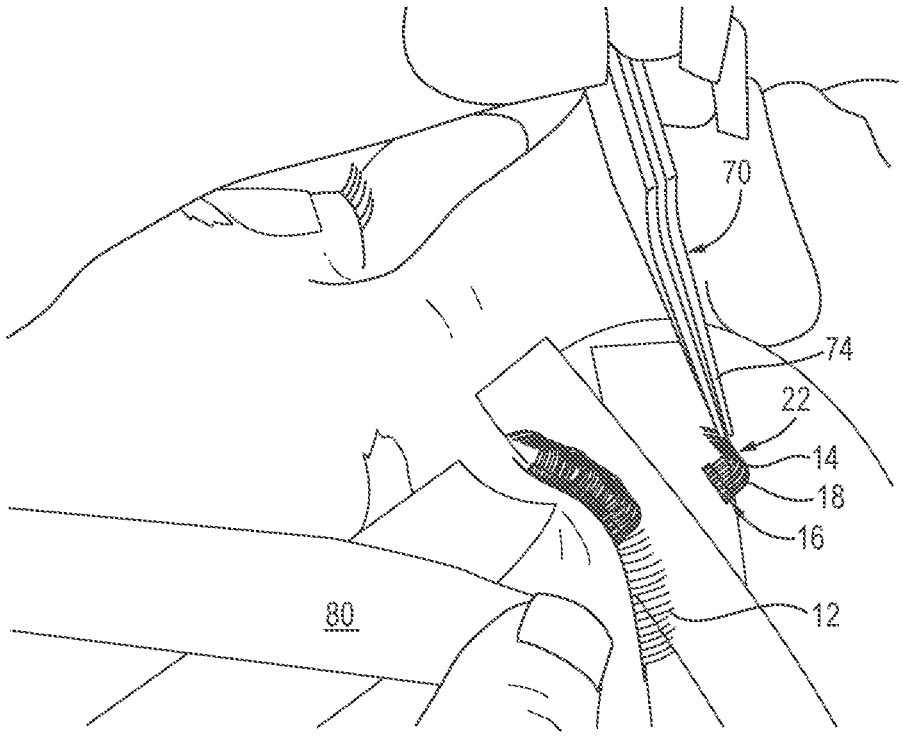
FIG. 22 is an illustration of a subject, masked below the upper eyelid and having a stabilizing mask on the upper eyelid to simplify application of a segment of a lash extension to the underside of the natural lashes.
Figure 23:
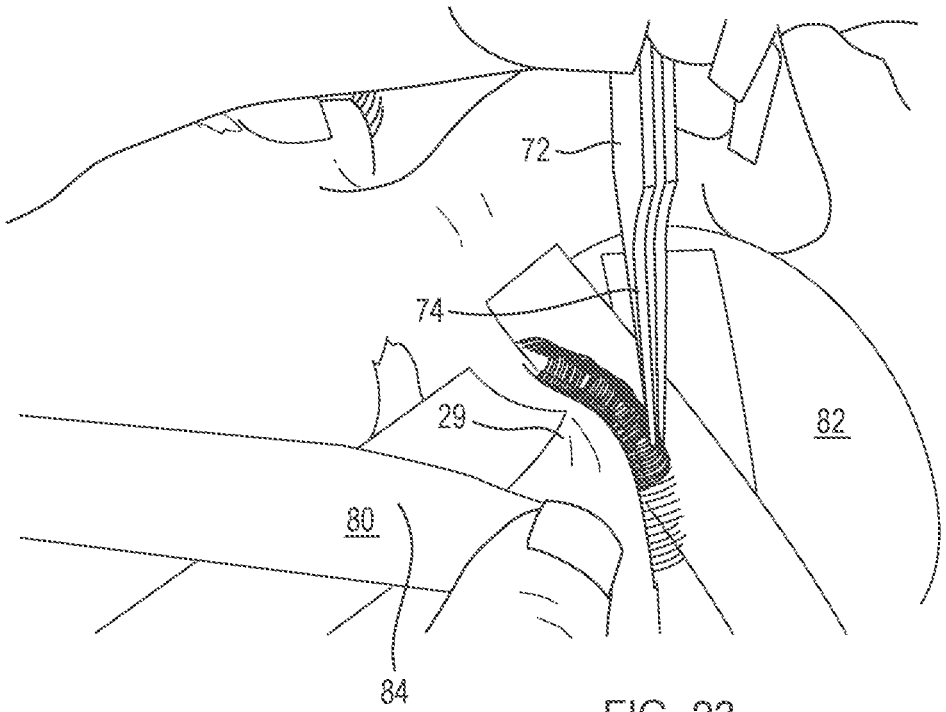
FIG. 23 is an illustration of the technician using the nibs of an application tweezer to affirmatively embed in the adhesive of a segment lashes, urging the adhesive on the band or tape portion of the segment to extrude between the natural lashes and confirm adhesion thereto.
Figure 24:
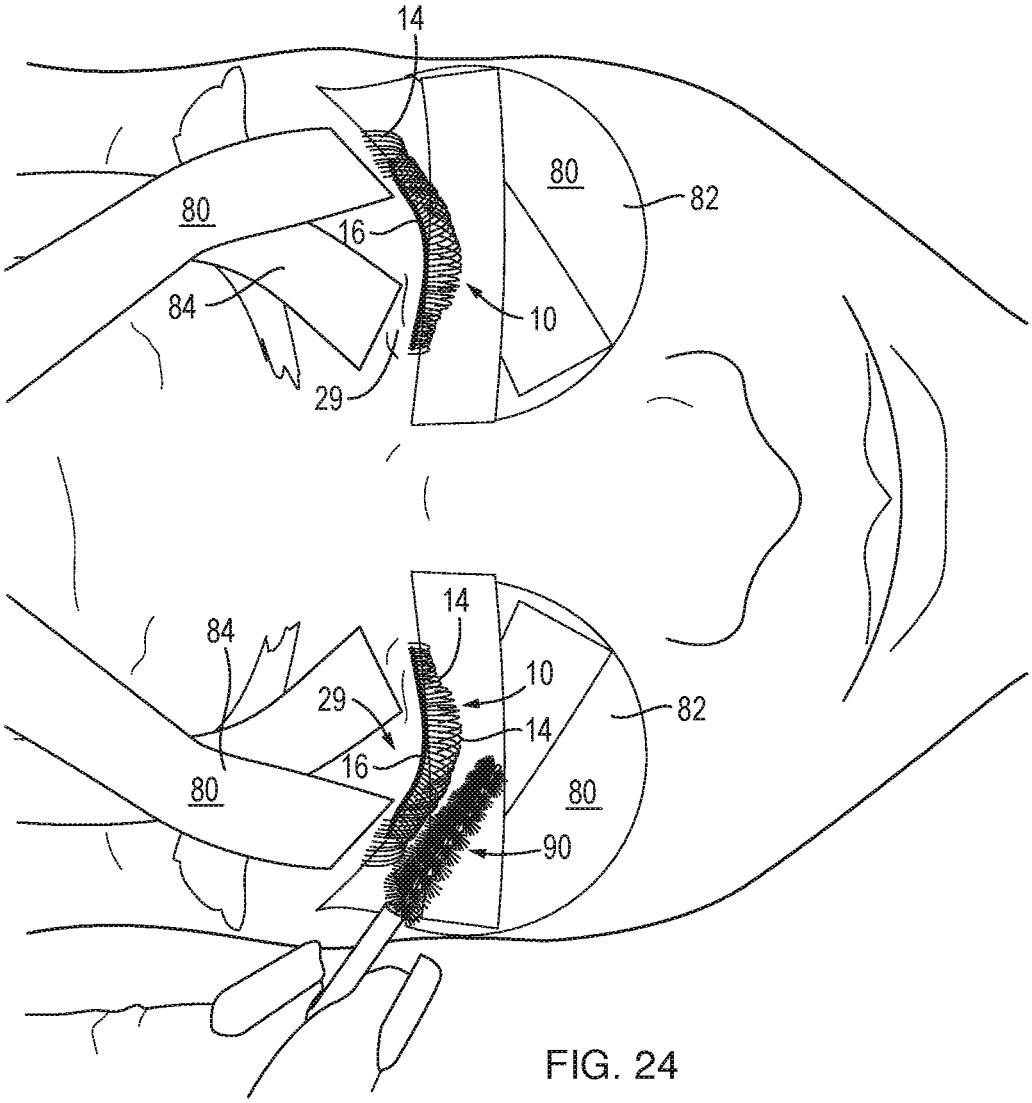
FIG. 24 is an illustration of a subject masked below the upper lashes and stabilization masked on the upper eyelid having a full set of extensions applied to the underneath side of the natural eyelashes, while the technician uses a brush to separate, fluff, and space uniformly the extension system installed or applied to each lash.

Referring to FIGS. 22 through 24, additional masking 80 may be applied. In the illustrated embodiment, the additional masking 80 on the upper eyelid 29 and over the eyebrow provides the ability of a technician to rest fingers or implements without contacting facial oils. Moreover, the segment 22 (in the nibs 74 of the tweezers 70) is held in the nibs 74 by the fibers 14 or filaments 14 thereof with the adhesive 18 upward facing on the band 16. In this way, the adhesive 18 may make immediate adhesion with the natural lash 12 upon contact.

Typically, the adhesive 18 is sufficiently soft that the pressure of contacting the adhesive 18 and band 16 against the underside of the natural lash 12 will be enough to temporarily support the weight of the segment 22 against the lash 12. Nevertheless, a technician may remove the segment 22 in order to more perfectly locate it, without damage. Ultimately, the segment 22 is placed in contact at a proper location and orientation against the underside of the lash 12. Then the nibs 74 may release the segment 22 and move into position to pressure the lashes 12 into the adhesive 18. This extrusion effects a complete and durable securement of the segment 22 to the lash 12.

Referring to FIG. 23, clamping or pressure application deforms the adhesive 18. The segment 22 is clamped such that the adhesive 18 is put under pressure between the band 16 below the adhesive 18, and the natural lash 12 under the nibs 74 thereabove. One will note that the masking 80, below the natural lash 12, as well as the masking 80 on and above the upper eyelid 29 provide stabilization and relaxation. The subject need not exert effort or muscular stress to maintain the eyes closed in the desired position. Meanwhile, instruments and fingers are protected against contamination by facial oils that might otherwise interfere with proper adhesion.

Referring to FIG. 24, following application of the extensions 10 on each eye, a brush 90 may be used to separate, orient, and otherwise urge a uniform spacing between the filaments 14. Ultimately, both the lower mask 82 and the upper or stabilizing mask 84 may be removed.

Figure 25:
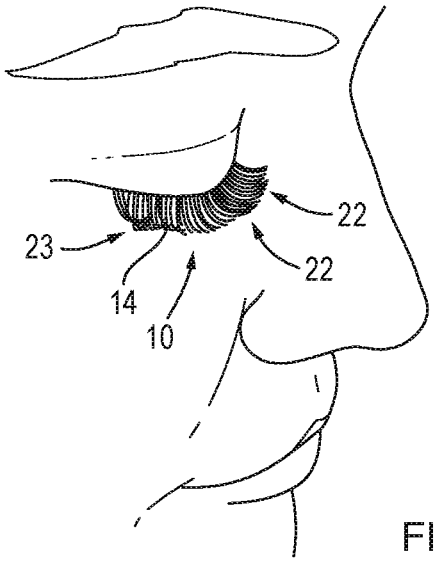
FIG. 25 is an illustration of a subject illustrating a completed, applied set of individual segments.

Referring to FIG. 25, the masks 80 being removed leave the applied extension 10 properly secured and having the desired appearance. One will note that the light reflection from the lash 12 and the filaments 14 of the extension 10 obscure the presence of the band 16 below the natural lash 12. Of course, the natural lash 12 is indistinguishable in this image from the extensions 10.

In certain embodiments, various adhesives may be used for various purposes and with various component pieces. Adhesives may be described generally in two categories, liquid adhesives and tape adhesives. Any suitable liquid adhesive 19 may be used. In one embodiment, a first adhesive, or liquid adhesive 19, may be used on natural eyelashes. Such a liquid adhesive 19 may be comprised of water, styrene/acrylates/ammonium methacrylate copolymer, an adhesion promoter, acrylate copolymer, and/or carbon black. The styrene/acrylates/ammonium methacrylate copolymer may be described as a film-forming agent that is water-resistant. In one embodiment, a liquid adhesive may be comprised of 1-methyl-2-pyrrolidone, ammonia (anhydrous), and carbon black. Any suitable tape adhesive may be used, including rheological and non-rheological materials. A tape adhesive may be described as a medical grade adhesive, pressure-sensitive adhesive, double-sided tape with acrylic on both sides. It may be described as a non-Newtonian adhesive compound, or a rheological material. It may include a highly conformable polyethylene carrier for maximum user comfort, and easily die cuttable into various shapes and sizes. The use of a pressure-sensitive adhesive may be helpful because it can allow for some repositioning of an artificial eyelash, or segment, before pressure is applied activating the adhesive and before the artificial eyelash is adhered to the natural eyelash.

Figure 26A:
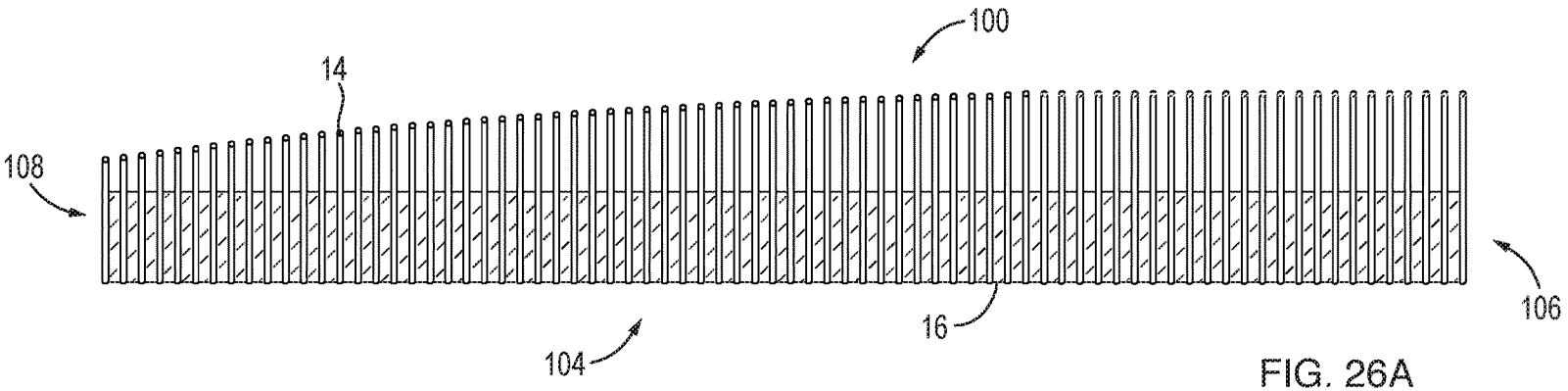
FIG. 26A is a schematic, plan view of a top, right, pre-cut artificial lash segment, magnified to show detail.
Figure 26B:
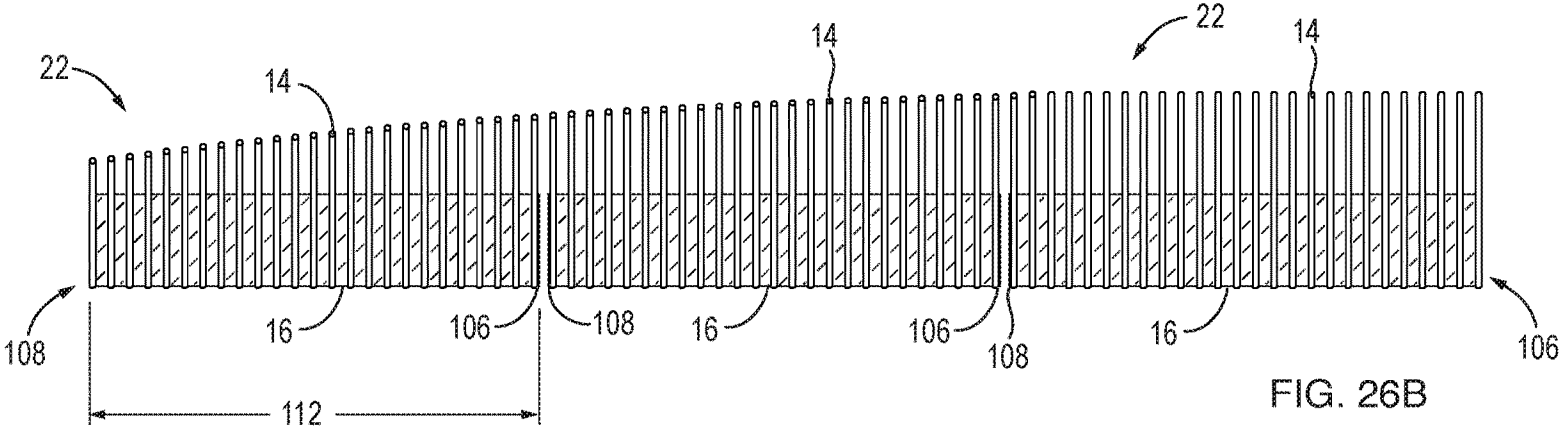
FIG. 26B is a schematic, plan view of a top, right, cut artificial lash segment, magnified to show detail.
Figure 26C:
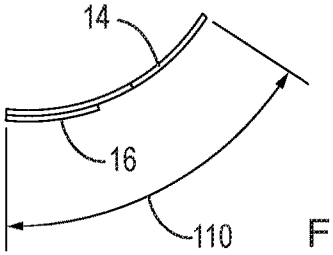
FIG. 26C is a side view of a top artificial lash.

Referring to FIGS. 26A-C, an embodiment of one or more artificial lash segments designed for use as top 104, right artificial lashes is shown. FIG. 26A illustrates a single-piece, pre-cut artificial lash segment 100 having an outer edge 106 and an inner edge 108. Such a one-piece lash segment 100 may include multiple, artificial lash fibers 14 and a tape base 16 to secure the fibers 14. FIG. 26B illustrates a cut artificial lash segment that is comprised of multiple, smaller segments 22, with each segment 22 having an outer edge 106 and an inner edge 108. Each segment 22 may include multiple, artificial lash fibers 14 and a tape base 16 to secure the fibers 14. Moreover, each segment 22, or one-piece segment 100, may have a segment length 112. A segment length 112 may be pre-determined or adjusted depending on the intended use for each lash segment. As applied or installed, an inner edge 108 may be positioned nearer a user's nose, while an outer edge 106 may be positioned away from a user's nose. FIG. 26C illustrates a side view of a lash fiber 14 and accompanying substrate or tape 16. A lash fiber 14 may have a lash length 110, wherein the lash length 110 may be pre-determined or adjusted depending on the intended use for the associated lash segment 22.

Figure 27A:
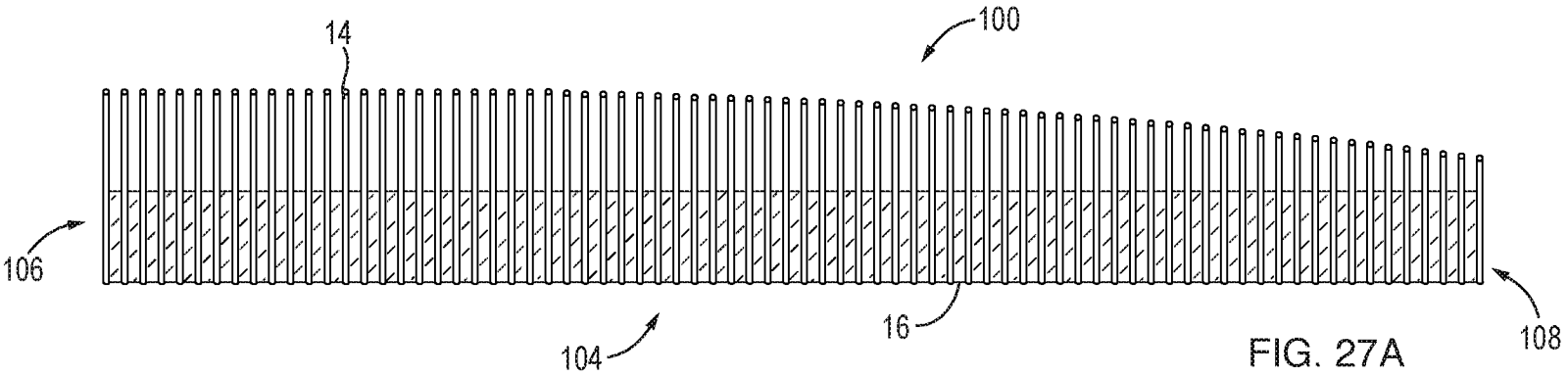
FIG. 27A is a schematic, plan view of a top, left, pre-cut artificial lash segment, magnified to show detail.
Figure 27B:
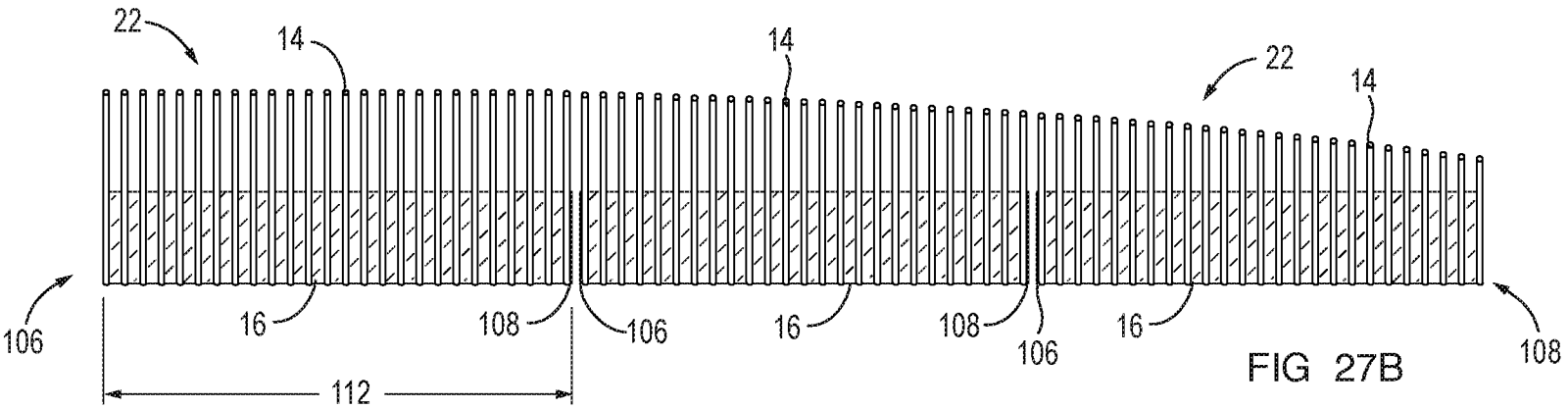
FIG. 27B is a schematic, plan view of a top, left, cut artificial lash segment, magnified to show detail.
Figure 27C:
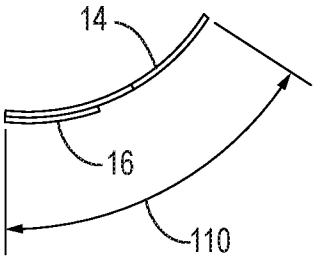
FIG. 27C is a side view of a top artificial lash.

Referring to FIGS. 27A-C, an embodiment of one or more artificial lash segments designed for use as top 104, left artificial lashes is shown. FIG. 27A illustrates a single-piece, pre-cut artificial lash segment 100 having an outer edge 106 and an inner edge 108. Such a one-piece lash segment 100 may include multiple, artificial lash fibers 14 and a tape base 16 to secure the fibers 14. FIG. 27B illustrates a cut artificial lash segment that is comprised of multiple, smaller segments 22, with each segment 22 having an outer edge 106 and an inner edge 108. Each segment 22 may include multiple, artificial lash fibers 14 and a tape base 16 to secure the fibers 14. Moreover, each segment 22, or one-piece segment 100, may have a segment length 112. A segment length 112 may be pre-determined or adjusted depending on the intended use for each lash segment. As applied or installed, an inner edge 108 may be positioned nearer a user's nose, while an outer edge 106 may be positioned away from a user's nose. FIG. 27C illustrates a side view of a lash fiber 14 and accompanying substrate or tape 16. A lash fiber 14 may have a lash length 110, wherein the lash length 110 may be pre-determined or adjusted depending on the intended use for the associated lash segment 22.

Figure 28A:
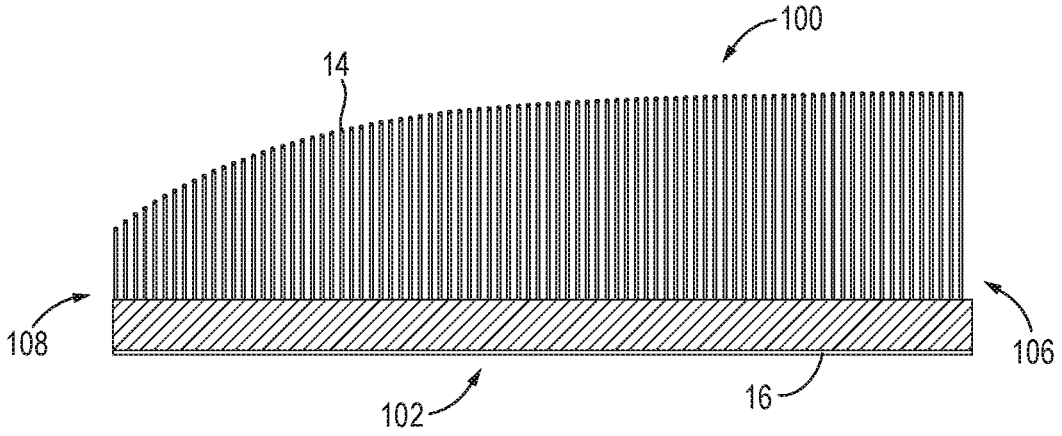
FIG. 28A is a schematic, plan view of a bottom, right, pre-cut artificial lash segment, magnified to show detail.
Figure 28B:
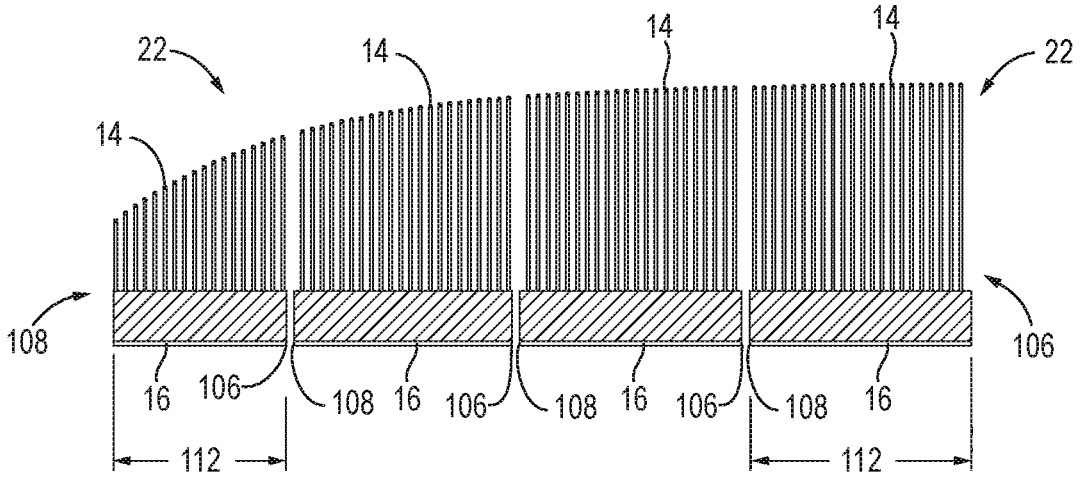
FIG. 28B is a schematic, plan view of a bottom, right, cut artificial lash segment, magnified to show detail.
Figure 28C:
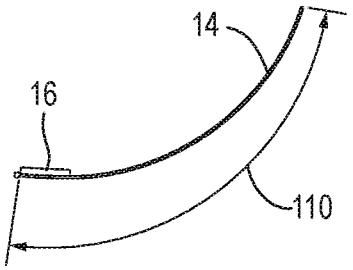
FIG. 28C is a side view of a bottom artificial lash.

Referring to FIGS. 28A-C, an embodiment of one or more artificial lash segments designed for use as bottom 102, right artificial lashes is shown. FIG. 28A illustrates a single-piece, pre-cut artificial lash segment 100 having an outer edge 106 and an inner edge 108. Such a one-piece artificial lash segment 100 may include multiple, artificial lash fibers 14 and a tape base 16 to secure the fibers 14. FIG. 28B illustrates a cut artificial lash segment that is comprised of multiple, smaller segments 22, with each segment 22 having an outer edge 106 and an inner edge 108. Each segment 22 may include multiple, artificial lash fibers 14 and a tape base 16 to secure the fibers 14. Moreover, each segment 22, or one-piece segment 100, may have a segment length 112. A segment length 112 may be pre-determined or adjusted depending on the intended use for each lash segment. As applied or installed, an inner edge 108 may be positioned nearer a user's nose, while an outer edge 106 may be positioned away from a user's nose. FIG. 28C illustrates a side view of a lash fiber 14 and accompanying substrate or tape 16. A lash fiber 14 may have a lash length 110, wherein the lash length 110 may be pre-determined or adjusted depending on the intended use for the associated lash segment 22.

Figure 29A:
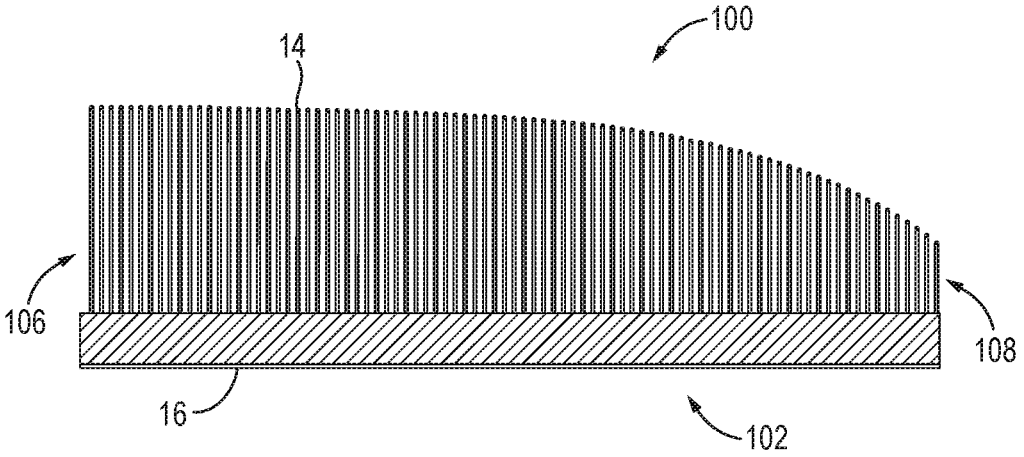
FIG. 29A is a schematic, plan view of a bottom, left, pre-cut artificial lash segment, magnified to show detail.
Figure 29B:
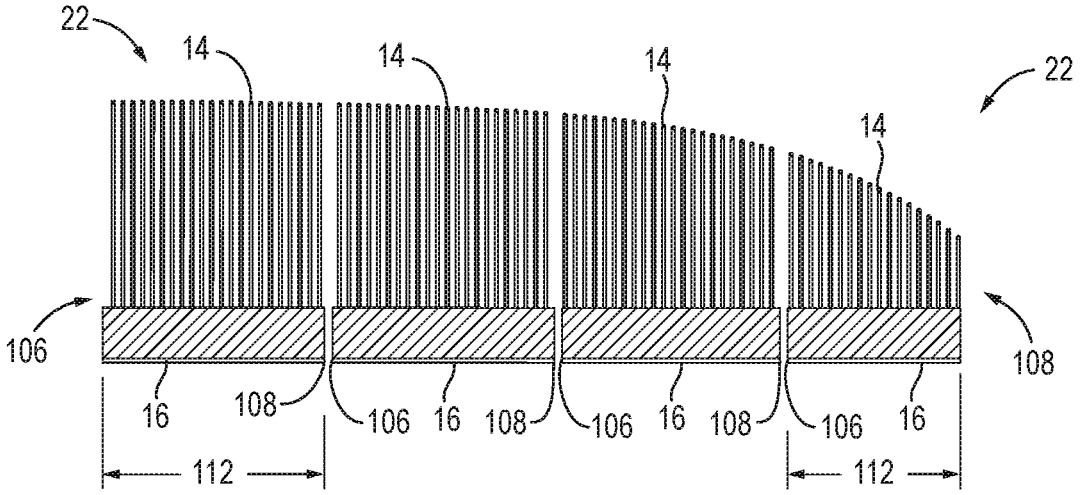
FIG. 29B is a schematic, plan view of a bottom, left, cut artificial lash segment, magnified to show detail.
Figure 29C:
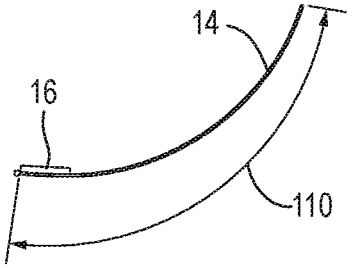
FIG. 29C is a side view of a bottom artificial lash.

Referring to FIGS. 29A-C, an embodiment of one or more artificial lash segments designed for use as bottom 102, left artificial lashes is shown. FIG. 29A illustrates a single-piece, pre-cut artificial lash segment 100 having an outer edge 106 and an inner edge 108. Such a one-piece lash segment 100 may include multiple, artificial lash fibers 14 and a tape base 16 to secure the fibers 14. FIG. 29B illustrates a cut artificial lash segment that is comprised of multiple, smaller segments 22, with each segment 22 having an outer edge 106 and an inner edge 108. Each segment 22 may include multiple, artificial lash fibers 14 and a tape base 16 to secure the fibers 14. Moreover, each segment 22, or one-piece segment 100, may have a segment length 112. A segment length 112 may be pre-determined or adjusted depending on the intended use for each lash segment. As applied or installed, an inner edge 108 may be positioned nearer a user's nose, while an outer edge 106 may be positioned away from a user's nose. FIG. 29C illustrates a side view of a lash fiber 14 and accompanying substrate or tape 16. A lash fiber 14 may have a lash length 110, wherein the lash length 110 may be pre-determined or adjusted depending on the intended use for the associated lash segment 22.

Individual artificial lash segments 22, or one-piece lash segments 100, may be used for different situations and intended uses. For example and not by way of limitation, smaller segments 22 may be easier to apply or position, but may require multiple segments 22 to achieve a desired appearance. Similarly, a one-piece artificial segment 100 may be more difficult to apply or position, but may not require multiple segments to achieve a desired appearance. One may understand that this may depend on adhesives used and desired appearances, which can vary depending on the person applying or using the eyelash extensions.

Figure 30:
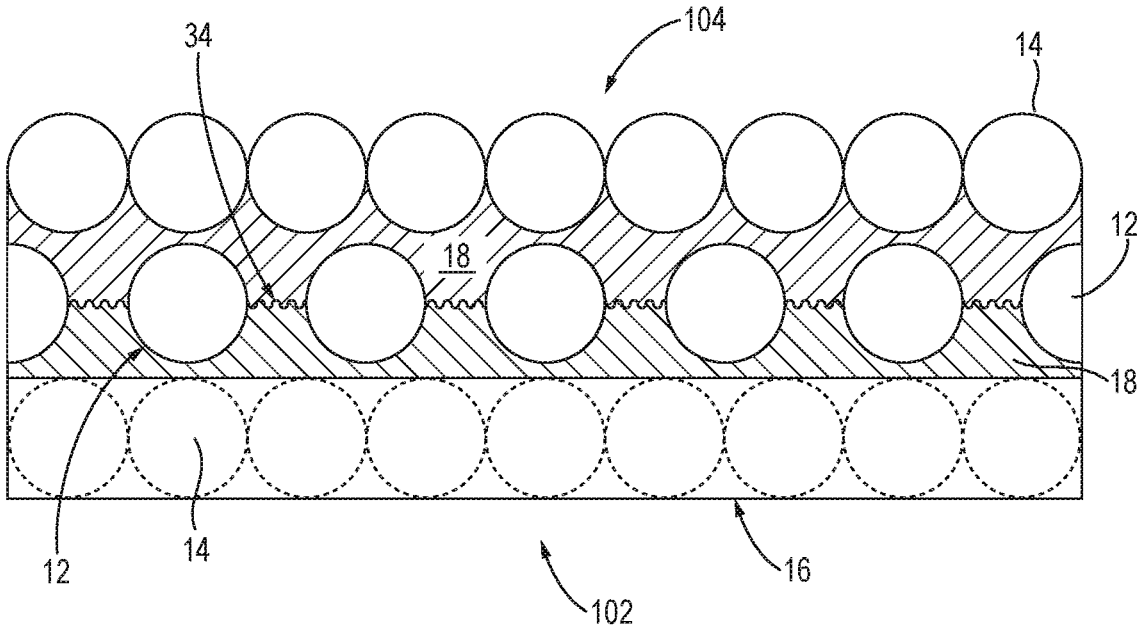
FIG. 30 is a cut view of one embodiment showing natural lashes with top and bottom artificial lashes adhered to the natural lashes.

Referring to FIG. 30, a configuration of how artificial lashes, or extensions, may be applied to natural lashes is illustrated. A bottom artificial eyelash 102 with a plurality of lash fibers 14 may include a base 16 with adhesive 18. A top artificial eyelash 104 with a plurality of lash fibers 14 may include adhesive 18. The bottom artificial eyelash 102 may be adhered to the bottom, or underside, of natural lashes 12 and the top artificial eyelash 104 may be adhered to the upper, or topside, of natural lashes 12 in a manner that allows the adhesives 18 associated with both the bottom artificial eyelash 102 and the top artificial eyelash 104 to form an interface 34, or joint 34, around the natural lashes 12. This configuration may be used to apply artificial lashes, or extensions, to the natural lashes 12 on either eyelid.

Figure 31A:
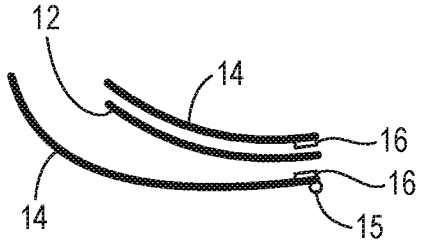
FIG. 31A is a side view of one embodiment showing a natural lash with top and bottom artificial lashes.
Figure 31B:
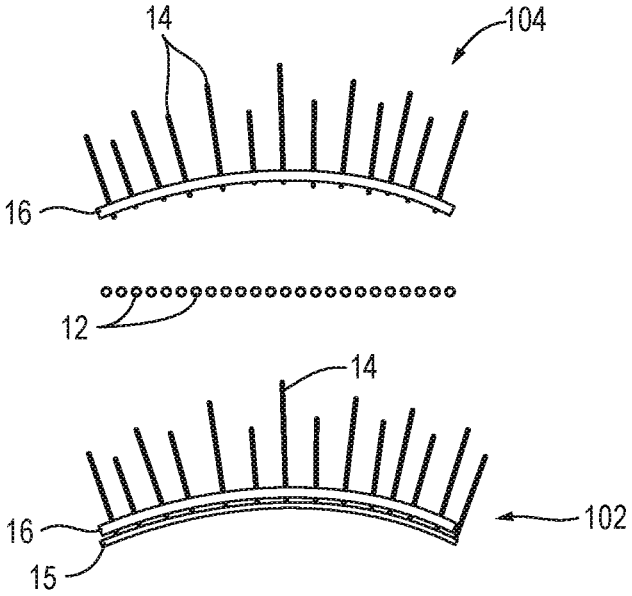
FIG. 31B is a layered view of one embodiment showing natural lashes with top and bottom artificial lashes.

Referring to FIGS. 31A-B, a configuration of how artificial lashes, or extensions, may be applied to natural lashes is illustrated. A bottom artificial eyelash 102 may include fibers 14 and may include tape 16 and may also include a transverse fiber 15 across the bottom of the bottom artificial eyelash 102. In one embodiment, a base of the bottom artificial eyelash 102 may be formed by heat fusion, before any adhesive is applied to the artificial eyelash. A top artificial eyelash 104 may include fibers 14 and may include tape 16. In one embodiment, a base of the top artificial eyelash 104 may be formed by heat fusion, before any adhesive is applied to the artificial eyelash. The bottom artificial eyelash 102 and the top artificial eyelash 104 may be applied on either side of natural lashes 12 in a manner that joins the tape 16, or tape adhesive 18, from both of the bottom artificial eyelash 102 and top artificial eyelash 104, and the transverse fiber 15 may be positioned to support the configuration from its underside.

Figure 32A:
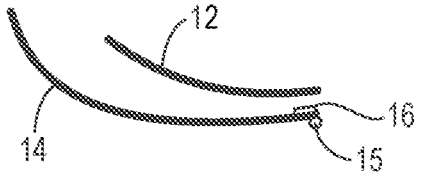
FIG. 32A is a side view of one embodiment showing a natural lash with a bottom artificial lash.
Figure 32B:
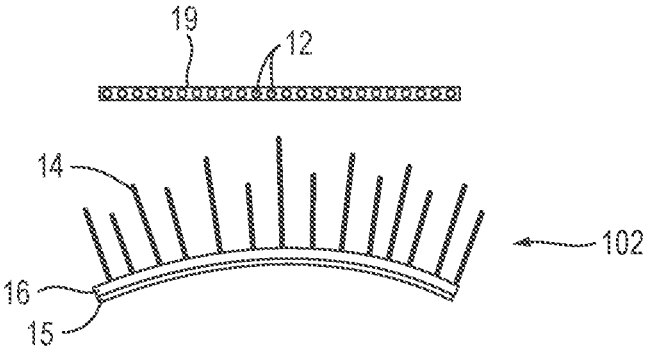
FIG. 32B is a layered view of one embodiment showing natural lashes with bottom artificial lashes.

Referring to FIGS. 32A-B, a configuration of how artificial lashes, or extensions, may be applied to natural lashes is illustrated. A bottom artificial eyelash 102 may include fibers 14 and may include tape 16 and may also include a transverse fiber 15 across the bottom of the bottom artificial eyelash 102. In one embodiment, a base of the bottom artificial eyelash 102 may be formed by heat fusion, before any adhesive is applied to the artificial eyelash. Natural lashes 12 may be coated with a liquid adhesive 19. The bottom artificial eyelash 102 may be applied to the underside of natural lashes 12 in a manner that joins the tape 16, or tape adhesive 18, from the bottom eyelash 102 and the liquid adhesive 19 on the natural lashes 12, and so the transverse fiber 15 may be positioned to support the configuration from its underside.

Any artificial eyelash, including without limitation, a bottom artificial eyelash 102 and a top artificial eyelash 104 and an artificial eyelash segment 22, may be described as having a proximate end and a distal end. The proximate end may include a band 16 or tape 16, and when applied, the proximate end of the artificial eyelash would be near or adjacent the eyelid of the natural eyelashes. The distal end of the artificial eyelash would be away from the eyelid of the natural eyelash, with the fibers at the distal end loose.

Figure 33:
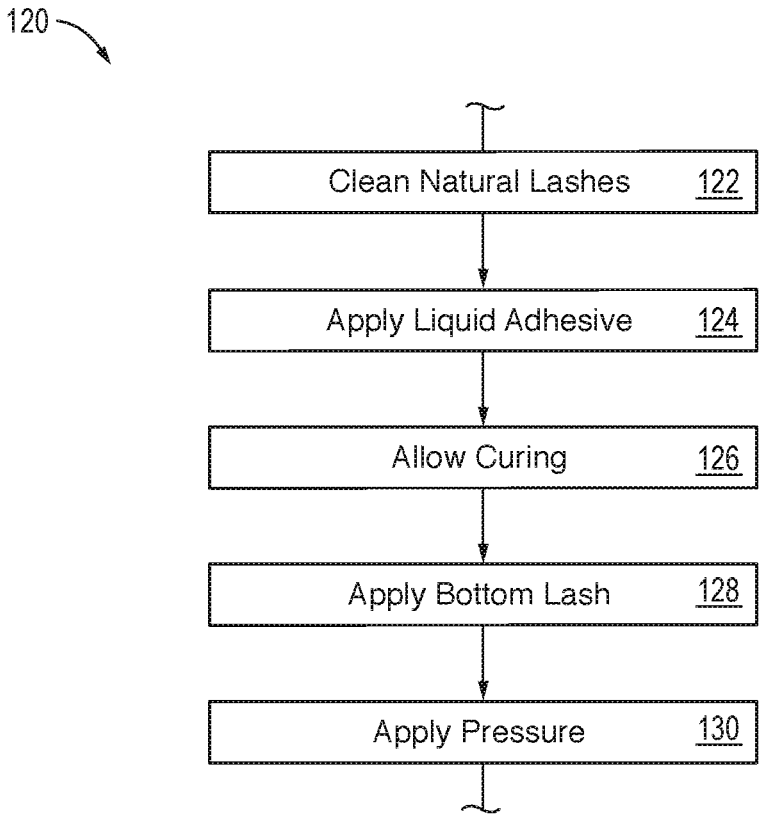
FIG. 33 is a schematic block diagram of one embodiment of a process for installation of an artificial lash segment.

Referring to FIG. 33, a process 120 in accordance with the invention for applying an extension, or artificial lash segment 22, to a natural lash 12 is illustrated. For example and not by way of limitation, an application process 120 may be used to apply a bottom artificial lash 102 to natural lashes 12, similar to the configuration shown in FIGS. 32A-B. An artificial lash may be applied to the underside of the natural lash, or to the topside of the natural lash 12.

Natural lashes 12 may be prepared to have extensions, or lash segments 22, or a bottom artificial eyelash 102, applied to them. The natural lashes may be cleaned 122 in any suitable manner. For example, a cleaning solution may be brushed onto the natural lashes so as to remove unwanted oils from the natural lash. In one embodiment, a method for applying an artificial eyelash extension, or segment, or bottom artificial eyelash, to a person may include a preparation step that includes using a primer, or preparatory solvent, that leaves a layer of plastic for the adhesive. An adhesion promoter may include an alcohol that removes oil from the natural lashes prior to placement of artificial eyelash extensions, or segments. An adhesion promoter may also or otherwise include an alcohol that utilizes oil present on the natural eyelashes to facilitate leaving a thin layer of plastic for the adhesive. For another example, the step of cleaning 122 may be as simple as wiping the natural eyelashes 12 with a cloth, dry or damp, to remove dirt or debris.

A liquid adhesive 19 may be applied 124 to the natural lashes 12. In one embodiment, a liquid adhesive 19 may be applied to prepare artificial eyelashes to be adhered to the natural lashes 12. In another embodiment, a liquid adhesive 19 may be used wherein the liquid adhesive 19 functions to clean the natural lashes, removing unwanted oils from the natural lashes, and to serve as an adhesive. In such an embodiment, a primer may not be necessary. In one embodiment, a liquid adhesive 19 may be applied using a mascara brush, or any other suitable tool or other suitable technique or manner. The liquid adhesive may be comprised of the following: styrene/acrylates/ammonium methacrylate copolymer, water, adhesion promoter, acrylate copolymer, and carbon black. Generally, the liquid adhesive 19 may be applied to the underside of the user's natural eyelash 12, and may be applied primarily at the base of the natural eyelash 12, although this application process may serve to coat the entire base of the natural eyelash with adhesive. The liquid adhesive 19 may be applied in any suitable manner. The liquid adhesive 19 may be described as a relatively thick, liquid adhesive, with a consistency similar to mascara. The use of the liquid adhesive 19 may allow the application process to proceed without the use of alcohol and/or other priming compounds, eliminating the need to prepare 122, or clean 122, the natural eyelash before the liquid adhesive 19 is applied. The elimination of this preparation step 122 can save a considerable amount of time in the application process 120, as well as saving a considerable amount of chemicals that are no longer required to complete the process.

The liquid adhesive may be allowed to cure 126. The liquid adhesive applied to the natural lashes may be allowed to cure by contact with the air, allowing the liquid adhesive to become tacky. The time to allow for curing 126 may be approximately ten (10) seconds, but may be any suitable time from about two (2) seconds to about sixty (60) seconds.

A bottom artificial eyelash, or extension, or any artificial lash segment, may be applied 128 to the natural lashes 12 so that the tape affixed to the bottom artificial eyelash, or artificial lash segment, adheres to the liquid adhesive on the natural lash. In one embodiment, a bottom artificial eyelash may include a tape 16 adhesive 18 that is pre-applied to the bottom artificial eyelash 102, or artificial segment 22. The pre-applied adhesive may be in any suitable form, including without limitation, tape, liquid, gel and/or elastic adhesives, and may be an uncured adhesive. In one embodiment, an adhesive may be absent and replaced with a heat fusion process, which process may also be described as forming a base or substrate 16. Such a bottom artificial eyelash may be configured so that the tape adhesive is already present on the bottom artificial eyelash and readily available to be applied to the natural lash. In the same embodiment or another embodiment, the bottom artificial eyelash may also include a transverse fiber 15 along the bottom of the bottom artificial eyelash. In one embodiment, packaging for artificial eyelash extensions, including without limitation bottom artificial eyelashes, that have been prepared and are ready to be applied to a user or person may be packaged in such a manner so that the backing film 21 for the adhesive tape 16 remains with the packaging as the artificial lash segment, or bottom artificial eyelash 102, is removed from the packaging just before the segment is affixed to the natural eyelashes of a user or person. In one embodiment, the packaging for the artificial lash segment 22, or bottom artificial eyelash 102, may include a backing layer between the packaging base and the tape adhesive 18. The backing layer may remain attached to the packaging base as the artificial lash segment 22, or bottom artificial eyelash 102, is removed from the packaging. The tape adhesive 18 will be exposed in preparation for application 128, and may begin to dry and/or cure as it is exposed to air. The tape adhesive 18 may be pressure-sensitive. The bottom artificial eyelash 102, or artificial eyelash segments 22, may be applied near the eyelid of the user as desired by the user. The tape adhesive 18 on the artificial eyelash should be placed where the liquid adhesive 19 was applied to the natural eyelash 12.

In one embodiment, the step of applying 128 a bottom artificial eyelash may include selecting an artificial lash segment 22, or bottom artificial eyelash 102. The artificial lash segment 22, or bottom artificial eyelash 102, may be comprised of artificial lashes or fibers 14 bound together in a short segment that may be approximately 1-20 millimeters in length. Also, the artificial lash segment 22, or bottom artificial eyelash 102, may be removed from its packaging in such a manner that a second adhesive 18, or tape adhesive 18, remains attached to the lower portion of the artificial lash segment 22, or bottom artificial eyelash 102, generally along the base of the artificial eyelash extension segment. The artificial lash segment 22, or bottom artificial eyelash 102, may be applied to the underside of a user's, or person's, natural eyelash. The tape adhesive 18 on the artificial eyelash should be placed where the liquid adhesive 19 was applied to the natural eyelash 12. One or more artificial eyelash segments 22 may be applied in a similar manner.

Pressure may be applied 130 to securely adhere the bottom artificial eyelash, or lash segment, to the natural lashes. Pressure may be applied 130 to thoroughly mix the liquid adhesive on the natural lashes 12 with the tape adhesive on the artificial eyelashes. In one embodiment, the artificial eyelash segment 22, or bottom artificial eyelash 102, now adjacent to the underside of the user's natural eyelash, may be crimped to activate a pressure-sensitive adhesive in the tape adhesive 18. This crimping 130, or applying pressure 130, may activate both the tape adhesive 18 and the liquid adhesive 19 allowing them to adhere together really well, and may allow for proper "mixing" of the adhesives. An artificial eyelash segment 22, or bottom artificial eyelash 102, that is applied and affixed in this manner may be expected to remain adhered to the user's natural eyelash for approximately 7-14 days. The liquid adhesive 19, or first adhesive 19, may adhere or bond better to the natural lashes than the tape adhesive 18, or second adhesive 18. The tape adhesive 18, or second adhesive 18, may adhere or bond better to the artificial lash fibers 14, or artificial eyelashes, than the liquid adhesive 19, or first adhesive 19. During the application process 120, the tape adhesive 18 adheres to the liquid adhesive 19 and may adhere in such a manner that allows the natural eyelashes to adjust, move, and grow in relation to the artificial lash segments 22, or bottom artificial eyelash 102, without pinching or wrinkling that can become uncomfortable for the user. The adhesion between the liquid adhesive 19 and the tape adhesive 18 may be described as a fluid bond that allows for relative movement of natural lashes in relation to the artificial lash segments 22, or bottom artificial eyelash 102. The mechanical surrounding of the natural lashes 12 by the liquid adhesive 19 may be a crucial step for establishing this fluid bond.

The application process 120, or adhesion process 120, may allow for a certain amount of movement between the adhesive, or adhesives, allowing a certain amount of movement between the natural eyelashes and the artificial eyelashes. In preferred embodiments, a configuration of artificial eyelashes affixed to natural eyelashes may still allow for "creep" of the natural eyelashes such that the natural eyelashes are allowed to grow as normal while the artificial eyelashes are attached without bunching or pinching occurring. The fluid bond of the adhesives may be instrumental in allowing for this "creep" to occur.

Any artificial eyelashes, or eyelash segments, applied in accordance with the application process 120, or any suitable variation of the process, may be removed by the user. A suitable remover, or remover solution, may be applied to the natural eyelashes 12, for example by brushing the remover solution onto the natural lashes. Any suitable remover solution may be used. A suitable remover solution may be characterized as a solution that weakens, dissolves, or breaks the bond between any adhesives used to adhere the artificial eyelashes to the natural eyelashes. Typically, the remover may be applied to the top of the natural eyelashes where the artificial eyelashes are adhered to the natural eyelashes. The remover should be applied to thoroughly wet the area where the artificial eyelashes will be removed. The remover may be allowed to sit on the eyelashes for a suitable amount of time, usually a few seconds will suffice. After the remover has been allowed to work on the adhesives and weaken the fluid bond, the artificial eyelashes may be removed. It is recommended that a user grab the artificial eyelashes near the base of the artificial eyelashes and gently pull the artificial eyelashes away from the natural eyelashes. The remover solution may be used to remove any residual adhesive on the natural eyelashes. After the artificial eyelashes have been removed, the natural eyelashes should be thoroughly cleaned by any suitable manner to remove any remover solution that may still be on the natural lashes.

In another embodiment of the application process 120, artificial lash segments 22, or a bottom artificial eyelash 102 and a top artificial eyelash 104, may be applied to a user's natural eyelash using a "sandwich" technique.

Natural lashes may be prepared to have extensions, or lash segments 22, or a bottom artificial eyelash 102 and top artificial eyelash 104, applied to them. The natural lashes may be cleaned 122 in any suitable manner. For example, a cleaning solution may be brushed onto the natural lashes so as to remove unwanted oils from the natural lash. In one embodiment, a method for applying an artificial eyelash extension, or segment 22, or bottom artificial eyelash 102 and top artificial eyelash 104, to a person may include a preparation step that includes using a primer, or preparatory solvent, that leaves a layer of plastic for the adhesive. An adhesion promoter may include an alcohol that removes oil from the natural lashes prior to placement of artificial eyelash extensions, or artificial segments. An adhesion promoter may also or otherwise include an alcohol that utilizes oil present on the natural eyelashes to facilitate leaving a thin layer of plastic for the adhesive. For another example, the step of cleaning 122 the natural eyelashes 12 may be very simple. A user may wipe the natural eyelashes 12 with a cloth, dry or damp, to remove dirt or debris.

A liquid adhesive 19 may be applied 124 to the natural lashes 12. In one embodiment, a liquid adhesive 19 may be applied to prepare artificial lashes to be adhered to the natural lashes 12. In another embodiment, a liquid adhesive 19 may be used wherein the liquid adhesive 19 functions to clean the natural lashes, removing unwanted oils from the natural lashes, and to serve as an adhesive. In such an embodiment, a primer may not be necessary. In one embodiment, a liquid adhesive 19 may be applied using a mascara brush, or any other suitable tool or other suitable technique or manner. The liquid adhesive may be comprised of the following: styrene/acrylates/ammonium methacrylate copolymer, water, adhesion promoter, acrylate copolymer, and carbon black. Generally, the liquid adhesive 19 may be applied to the underside of the user's natural eyelash, and primarily to the base of the natural eyelash 12, although this application process may serve to coat the entire base of the natural eyelash with adhesive. The liquid adhesive 19 may be applied in any suitable manner. The liquid adhesive 19 may be described as a relatively thick, liquid adhesive, with a consistency similar to mascara. The use of the liquid adhesive 19 may allow the application process to proceed without the use of alcohol and/or other priming compounds, eliminating the need to prepare 122, or clean 122, the natural eyelash before the liquid adhesive 19 is applied. The elimination of this preparation step 122 can save a considerable amount of time in the application process 120, as well as saving a considerable amount of chemicals that are no longer required to complete the process.

The liquid adhesive 19 may be allowed to cure 126. The liquid adhesive applied to the natural lashes may be allowed to cure by contact with the air, allowing the liquid adhesive to become tacky. The time to allow for curing 126 may be approximately ten (10) seconds. Any suitable amount of time to allow curing may be used, including without limitation approximately two (2) seconds to approximately sixty (60) seconds.

A bottom artificial eyelash 102, or extension, or any artificial lash segment, may be applied 128 to the natural lashes so that the tape affixed to the bottom artificial eyelash, or lash segment, adheres to the liquid adhesive on the natural lash. In one embodiment, a bottom artificial eyelash 102 may include a tape 16 adhesive 18 that is pre-applied to the bottom artificial eyelash, or segment 22. The pre-applied adhesive may be in any suitable form, including without limitation, tape, liquid, gel and/or elastic adhesives, and may be an uncured adhesive. In one embodiment, an adhesive may be absent and replaced with a heat fusion process, which process may also be described as forming a base or substrate 16. Such a bottom artificial eyelash may be configured so that the tape adhesive is already present on the bottom artificial eyelash and readily available to be applied to the natural lash. In one embodiment, a top artificial eyelash 104 may include a tape 16 adhesive 18 that is pre-applied to the top artificial eyelash, or segment 22. The pre-applied adhesive may be in any suitable form, including without limitation, tape, liquid, gel and/or elastic adhesives, and may be an uncured adhesive. In one embodiment, an adhesive may be absent and replaced with a heat fusion process, which process may also be described as forming a base or substrate 16. In the same embodiment or another embodiment, the bottom artificial eyelash may also include a transverse fiber 15 along the bottom of the bottom artificial eyelash 102. In one embodiment, packaging for artificial eyelash extensions, including without limitation bottom artificial eyelashes, that have been prepared and are ready to be applied to a user or person may be packaged in such a manner so that the backing film 21 for the adhesive tape 16 remains with the packaging as the artificial lash segment, or bottom artificial eyelash, is removed from the packaging just before the segment is affixed to the natural eyelashes of a user or person. In one embodiment, the packaging for the artificial lash segment 22, or bottom artificial eyelash 102, may include a backing layer between the packaging base and the tape adhesive 18. The backing layer may remain attached to the packaging base as the artificial lash segment 22, or bottom artificial eyelash 102, is removed and may begin to dry and/or cure as it is exposed to air. The tape adhesive 18 may be pressure-sensitive. The bottom artificial eyelash 102, or artificial eyelash segments 22, may be applied near the eyelid of the user as desired by the user. The tape adhesive 18 on the artificial eyelash should be placed where the liquid adhesive 19 was applied to the natural eyelash 12.

In one embodiment, the step of applying 128 a bottom artificial eyelash and a top artificial eyelash, may include selecting artificial lash segments 22, or a bottom artificial eyelash 102 and a top artificial eyelash 104. The artificial lash segments 22, or bottom artificial eyelash 102 and top artificial eyelash 104, may be comprised of artificial lashes bound together in a short segment that may be approximately 1-20 millimeters in length, perhaps approximately 10 millimeters in length. Also, the artificial lash segments 22, or bottom artificial eyelash 102 and top artificial eyelash 104, may be removed from its packaging in such a manner that a second adhesive 18, or tape adhesive 18, remains attached to the lower portion of the artificial lash segments 22, or bottom artificial eyelash 102 and top artificial eyelash 104, generally along the base of the artificial eyelash extension segment. The artificial lash segments 22, or bottom artificial eyelash 102 and top artificial eyelash 104, may be applied to the underside and topside of a user's natural eyelash 12. A bottom artificial eyelash 102 is generally applied to the underside of a natural eyelash and a top artificial eyelash 104 is generally applied to the topside of a natural eyelash. One or more artificial eyelash segments 22 may be applied to both sides of a natural eyelash in a similar manner. The artificial eyelash segments may be applied near the eyelid of the user as desired by the user. The tape adhesive 18 on the artificial eyelash should be placed where the liquid adhesive 19 was applied to the natural eyelash 12.

Pressure may be applied 130 to securely adhere the bottom artificial eyelash and top artificial eyelash, or artificial lash segments, to the natural lashes. Pressure may be applied 130 to thoroughly mix the liquid adhesive 19 on the natural lashes 12 with the tape adhesive 18 on the artificial eyelashes. In one embodiment, the artificial eyelash segments 22, or bottom artificial eyelash 102 and top artificial eyelash 104, now "sandwiched" on both sides of the user's natural eyelash 12, may be crimped to activate a pressure-sensitive adhesive in the tape adhesive 18. This crimping 130, or applying pressure 130, may activate both the tape adhesive 18 and the liquid adhesive 19 allowing them to adhere together really well, and may allow for proper "mixing" of the adhesives. Artificial eyelash segments 22, or bottom artificial eyelash 102 and top artificial eyelash 104, that are applied and affixed in this manner may be expected to remain adhered to the user's natural eyelash for approximately 14-28 days. The liquid adhesive 19, or first adhesive 19, may adhere or bond better to the natural lashes 12 than the tape adhesive 18, or second adhesive 18. The tape adhesive 18, or second adhesive 18, may adhere or bond better to the artificial lash fibers 14, or artificial eyelashes, than the liquid adhesive 19, or first adhesive 19. The liquid adhesive 19 and the tape adhesive 18 bond well to each other, and may be described as forming a fluid bond. During the application process 120, the tape adhesive 18 adheres to the liquid adhesive 19 and may adhere in such a manner that allows the natural eyelashes to adjust, move, and grow in relation to the artificial lash segments 22, or bottom artificial eyelash 102 and top artificial eyelash 104, without pinching or wrinkling that can become uncomfortable for the user. The adhesion between the liquid adhesive 19 and the tape adhesive 18 may be described as a fluid bond that allows for relative movement of natural lashes in relation to the artificial lash segments 22, or bottom artificial eyelash 102 and top artificial eyelash 104. The mechanical surrounding of the natural lashes 12 by the liquid adhesive 19 may be a crucial step for establishing this fluid bond.

The application process 120, or adhesion process 120, may allow for a certain amount of movement between the adhesive, or adhesives, allowing a certain amount of movement between the natural eyelashes and the artificial eyelashes. This movement may be accomplished, at least in part, because of the fluid bond created by the adhesives. In preferred embodiments, a configuration of artificial eyelashes affixed to natural eyelashes may still allow for "creep" of the natural lashes such that the natural lashes are allowed to grow as normal while the artificial eyelashes are attached without bunching or pinching occurring.

Some of the benefits to this process 120 may include a more robust adhesion result. Also very important, the result is significantly more comfortable for the user. The comfort level, and the duration of the comfort level, provided by this process 120 is surprising and unexpected as compared to other, previous application techniques or processes.

Referring to FIGS. 34-39, a procedure for producing one embodiment of a top artificial eyelash 104, or top lash segment 22, is illustrated. During any manufacturing or production procedure, raw materials should be handled carefully. For example and not by way of limitation, powder-free, nitrile rubber gloves may be worn at all times, including when handling adhesive tape 16. Gloves should be kept free of oils, dirt, or debris of any kind and should be replaced if they become contaminated at all. Any tooling and work surfaces that contact an adhesive tape, including without limitation a block 140 or mat 144, should be kept clean, and cleaned using 99% Isopropanol. Other cleaners, such as acetone, should not be used because acetone and other cleaners may leave a thin film that can harm adhesion. An adhesive tape 16 should be stored in a temperature-controlled environment, at 15-27° C., with a relative humidity maintained at approximately 10-15%, in an airtight container, and away from direct, ultraviolet exposure.

Figure 34:
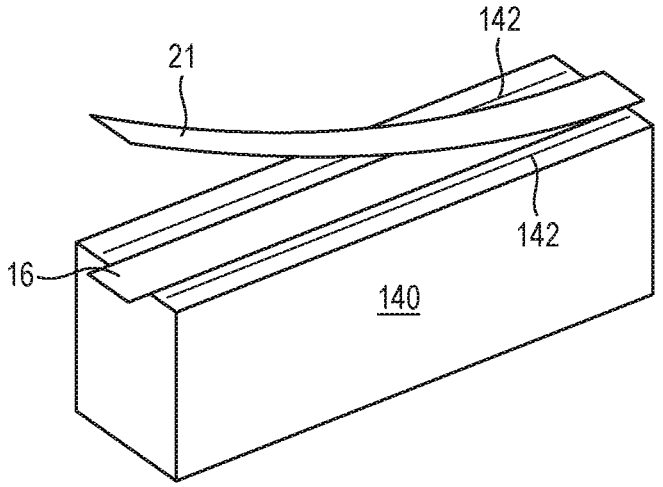
FIG. 34 is a diagram of one embodiment of a production process for a top, artificial lash segment showing initial tape placement.

Referring to FIG. 34, a block 140 may be used as a foundation for the procedure, which block 140 may include placement marks 142, or guides 142, for alignment of the components of a lash segment. A first piece of tape 16 may be placed on the block, and may be placed between the placement marks 142. A backer 21, or film 21, may be removed from tape 16 to expose an adhesive 18. When adding an adhesive tape 16 to an artificial eyelash extension or segment, if necessary, transfer of the adhesive tape 16 may be performed using specified release film 21.

Figure 35:
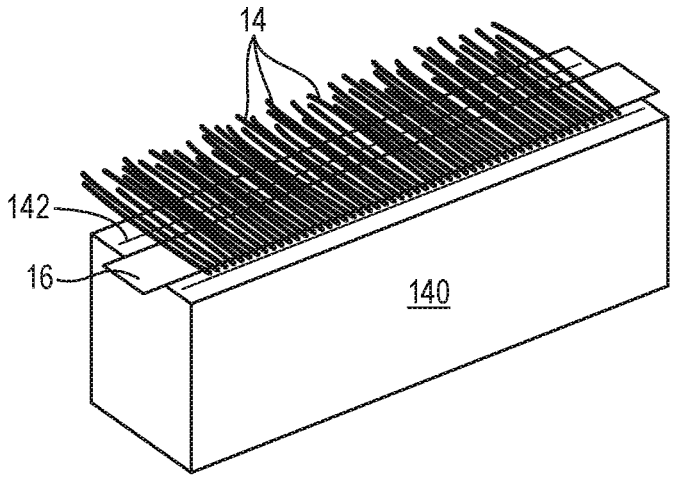
FIG. 35 is a diagram of one embodiment of a production process for a top, artificial lash segment showing placement of lash fibers.

Referring to FIG. 35, a plurality of artificial lash fibers 14 may be arranged so that the lower portion of the fibers 14 is placed against the tape 16, and the fibers 14 may adhere to the tape 16. Lashes and lash fibers 14 should be clean of any oil and residues from any previous manufacturing processes.

Figure 36:
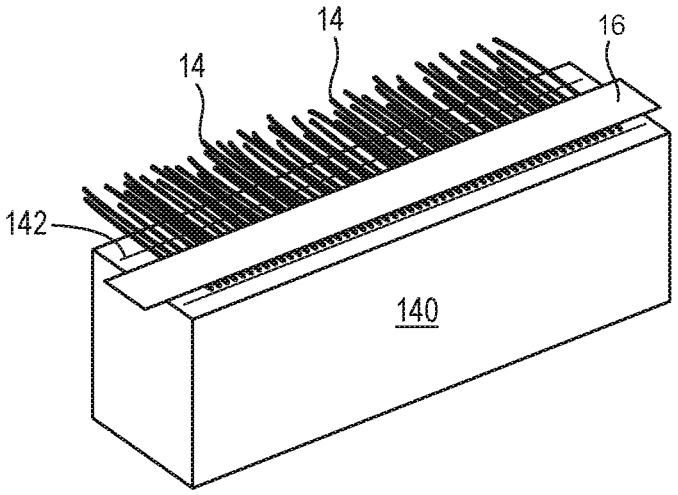
FIG. 36 is a diagram of one embodiment of a production process for a top, artificial lash segment showing placement of securing tape.

Referring to FIG. 36, a second piece of tape 16 may be placed over the plurality of artificial lash fibers 14 so that an adhesive 18 secures the fibers 14 between the first and second pieces of tape 16. The adhesive tape 16 should be positioned quickly, under approximately 20 seconds, once the release film 21 is removed. The adhesive's exposure to air should be limited. The adhesive tape 16 should be pressed down with a certain amount of force to ensure maximum bond to lashes. The adhesive 18 is pressure sensitive, so it should be pressed with a minimum force of approximately 95-100 $N/cm^2$. When the adhesive tape is pressed onto lashes, or substrate, it should be held at force for at least three (3) seconds. The placement location of the adhesive tape in reference to the base of the lashes should be identified and adhered to.

Figure 37:
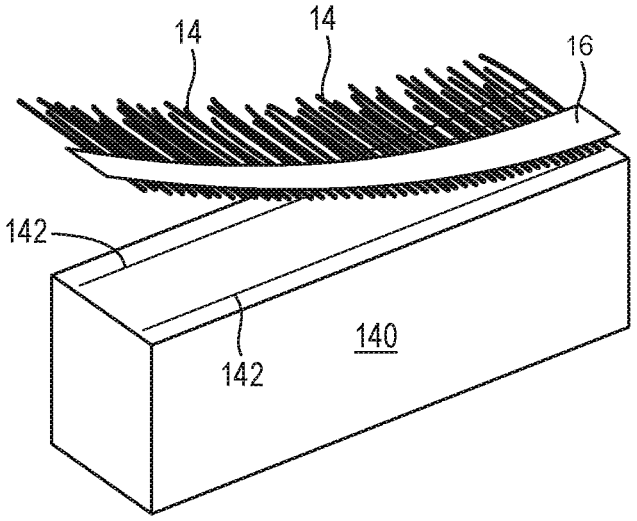
FIG. 37 is a diagram of one embodiment of a production process for a top, artificial lash segment showing removal of artificial lash segment.

Referring to FIG. 37, the extension, or lash segment 22, may be removed from the block 140. The removal should occur in a manner that maintains the shape of the lash segment 22. If the lash segment 22 is damaged or its shape is distorted, the lash segment 22 may need to be discarded and the production process started again from the beginning.

Figure 38:
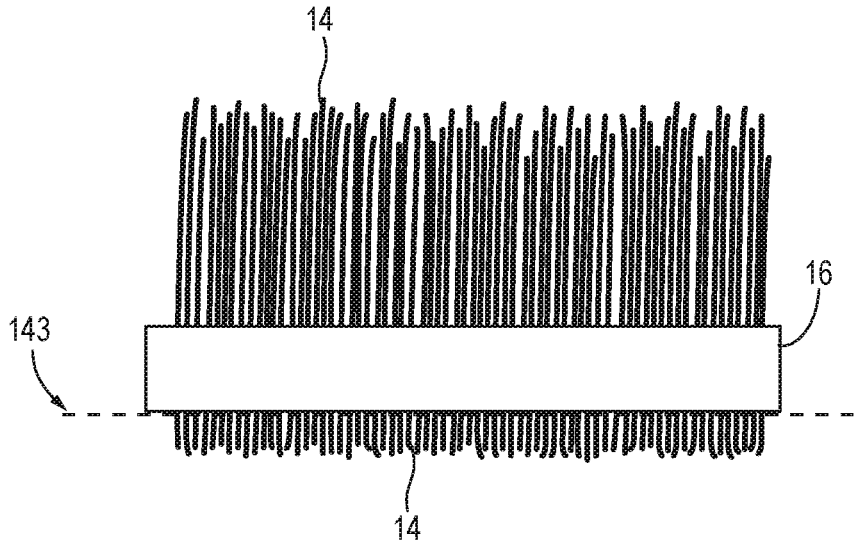
FIG. 38 is a diagram of one embodiment of a production process for a top, artificial lash segment showing placement and preparation for cutting of artificial lash segment.
Figure 39:
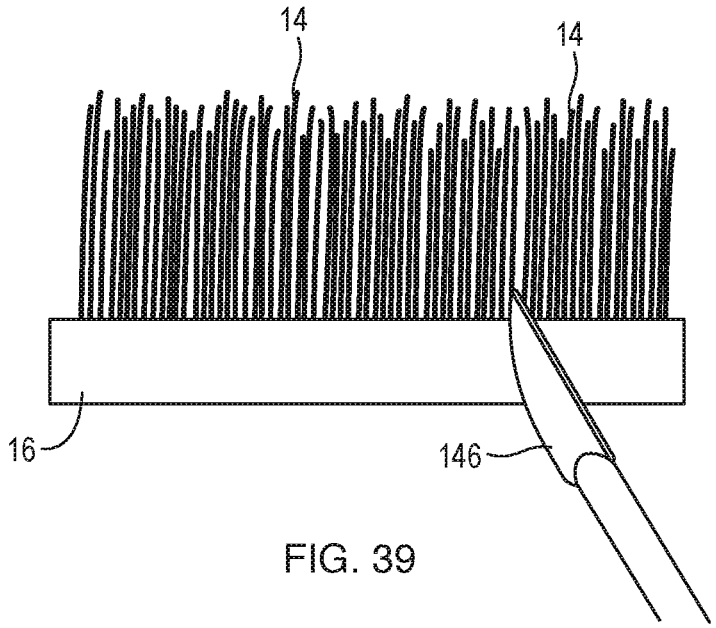
FIG. 39 is a diagram of one embodiment of a production process for a top, artificial lash segment showing cut artificial lash segment.

Referring to FIGS. 38-39, the extension, or lash segment 22, may be positioned in a manner that allows the lower portion of the fibers 14 to be cut so that the bottom of the lash segment 22 is even. The lash segment 22 may be placed on a surface that includes a cut line 143 so that the fibers 14 may be cut evenly using a knife 146, or other appropriate cutting tool 146. When cutting eyelash extensions into segments, or cutting segments to obtain a desired shape or configuration, the blade 146 should be clean and sharp for each use. The cut should be made to conform to desired widths and shapes specified in drawings and/or instructions.

Figure 40:
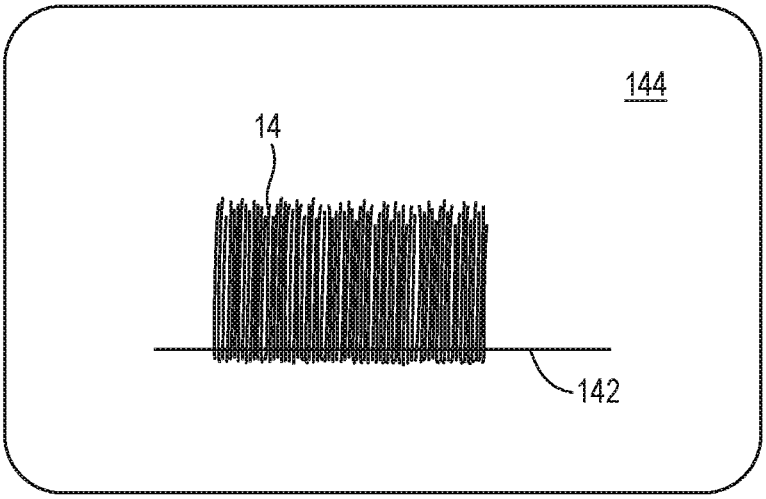
FIG. 40 is a diagram of one embodiment of a production process for a bottom, artificial lash segment showing initial placement of lash fibers.
Figure 41:
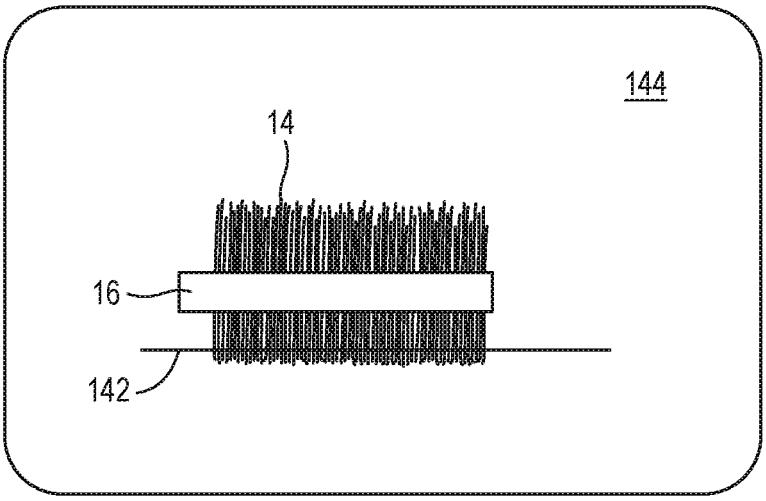
FIG. 41 is a diagram of one embodiment of a production process for a bottom, artificial lash segment showing placement of tape.
Figure 42:
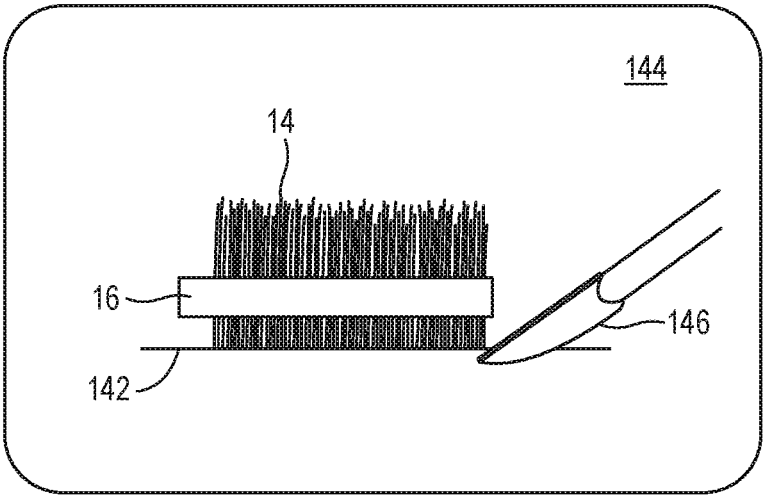
FIG. 42 is a diagram of one embodiment of a production process for a bottom, artificial lash segment showing cut artificial lash segment.

Referring to FIGS. 40-42, a procedure for producing one embodiment of a bottom lash 102, or bottom lash segment 22, is illustrated. Referring to FIG. 40, a mat 144 may be provided that includes a placement mark 142, or guide 142, to help with positioning. Referring to FIG. 41, a plurality of artificial lash fibers 14 may be arranged on the mat 144 and near the placemark mark 142. A piece of tape 16 may be placed over the plurality of fibers 14 to keep the fibers held together as a bottom lash 102, or a lash segment 22. Referring to FIG. 42, a knife 146, or other appropriate cutting tool 146, may be used to cut the fibers 14 so that the lower portion of the lash segment 22 is even.

The present invention may be embodied in other specific forms without departing from its fundamental functions or essential characteristics. The described embodiments are to be considered in all respects only as illustrative, and not restrictive. All changes which come within the meaning and range of equivalency of the illustrative embodiments are to be embraced within their scope.

What is claimed and desired to be secured by United States Letters Patent is:

1. A method for applying an artificial eyelash to a natural eyelash, comprising:

applying a first adhesive to the natural eyelash;

applying a first artificial eyelash to an underside of the natural eyelash, wherein the first artificial eyelash comprises a first proximate end, a first distal end, and a second adhesive that is pre-applied near the first proximate end and substantially along a length of the first proximate end, wherein the second adhesive is different from the first adhesive; and applying pressure to the first artificial eyelash to secure the first adhesive, the second adhesive of the first artificial eyelash, and the natural eyelash together, wherein the pressure is applied at a location of the first artificial eyelash corresponding to the second adhesive and a portion of the natural eyelash corresponding to where the first adhesive is applied, wherein securing the first adhesive, the second adhesive of the first artificial eyelash, and the natural eyelash together creates a bond between the first adhesive and the second adhesive that attaches the first artificial eyelash to the natural eyelash and allows relative movement between the natural eyelash and the first artificial eyelash at the location.

2. The method of claim 1, wherein a transverse fiber is along the length of the first proximate end and on a side of the first artificial eyelash opposite from the second adhesive.

3. The method of claim 2, wherein the first adhesive is a liquid adhesive and the second adhesive is a pressure-sensitive tape adhesive.

4. The method of claim 3, wherein the first adhesive comprises styrene/acrylates/ammonium methacrylate copolymer, water, adhesion promoter, acrylate copolymer, and carbon black.

5. The method of claim 4, wherein the first artificial eyelash is removable from a packaging in a manner that allows the second adhesive to become exposed as the first artificial eyelash is removed from the packaging.

6. The method of claim 5, wherein the first artificial eyelash is configured to be adhered to the natural eyelash based on a curing time of two seconds to sixty seconds.

7. The method of claim 4, wherein the first artificial eyelash is configured to stay adhered to the natural eyelash for at least three (3) days.

8. The method of claim 4, further comprising:

applying a second artificial eyelash to a topside of the natural eyelash, wherein the second artificial eyelash comprises a second proximate end and a second distal end, and wherein the second adhesive is pre-applied near the second proximate end and substantially along a length of the second proximate end; and applying pressure to the second artificial eyelash to secure the first adhesive, the second adhesive of the second artificial eyelash, and the natural eyelash together.

9. The method of claim 1, wherein the second adhesive is a non-Newtonian adhesive.

10. The method of claim 1, wherein an edge of the first proximate end is folded laterally.

11. The method of claim 1, wherein the first adhesive is formulated to adhere better to the natural eyelash, and the second adhesive is formulated to adhere better to the first artificial eyelash.

12. The method of claim 1, further comprising providing an artificial eyelash kit comprising the first artificial eyelash, the first adhesive, and the second adhesive.

13. A method for applying an artificial eyelash to a natural eyelash, comprising:

applying a first adhesive to the natural eyelash;

applying the artificial eyelash to the natural eyelash, wherein the artificial eyelash comprises a proximate end, a distal end, and a second adhesive that is pre-applied near the proximate end and substantially along a length of the proximate end, wherein the second adhesive is different from the first adhesive; and applying pressure to the artificial eyelash to secure the first adhesive, the second adhesive, and the natural eyelash together and to form a bond between the first adhesive and the second adhesive, wherein the pressure is applied at a location of the first artificial eyelash corresponding to the second adhesive and a portion of the natural eyelash corresponding to where the first adhesive is applied, wherein the bond allows the first artificial eyelash to be attached to the natural eyelash and allows relative movement between the natural eyelash and the artificial eyelash at the location.

14. The method of claim 13, wherein the second adhesive is a pressure-sensitive tape adhesive and the first adhesive is a liquid adhesive comprising styrene/acrylates/ammonium methacrylate copolymer, water, adhesion promoter, acrylate copolymer, and a color component.

15. The method of claim 14, wherein the artificial eyelash is removable from a packaging in a manner that allows the second adhesive to become exposed as the artificial eyelash is removed from the packaging.

16. The method of claim 15, wherein the artificial eyelash is configured to be adhered to an underside of the natural eyelash based on a curing time of two seconds to sixty seconds and further configured to stay adhered to the natural eyelash for at least seven (7) days.

17. The method of claim 13, wherein a transverse fiber is along the length of the proximate end and on a side of the artificial eyelash opposite from the second adhesive.

18. A method for applying artificial eyelash segments to an eyelash comprising:

providing a plurality of segments, each segment comprising a plurality of filaments, each filament comprising a base portion, which is secured at least semi-permanently to a substrate, and a tip, which is located a predetermined distance away from the substrate, the segments each having a width less than half a width of the eyelash and being capable of combining with an adjacent segment to extend laterally across the eyelash;

selecting a set of the segments, based on a length and width of each segment;

selecting a first segment of the set, based on a length and width of the first segment;

applying a first adhesive to at least a first portion of the eyelash;

exposing the first portion of the eyelash having the first adhesive to a second adhesive on the first segment by positioning the first segment proximate the first portion and contacting the first portion with the second adhesive, wherein the second adhesive is pre-applied near the substrate of the first segment and is different from the first adhesive; and embedding the first portion having the first adhesive in the second adhesive by compressing the substrate and the first portion together to form a bond between the first adhesive and the second adhesive that attaches the first segment to the first portion of the eyelash and allows relative movement between the first portion of the eyelash and the first segment at a location corresponding to where the first portion is embedded with the second adhesive.

19. The method of claim 18, further comprising extending the eyelash along the width thereof by embedding additional portions of the eyelash into subsequent ones of the segments applied thereto.

20. The method of claim 19, further comprising extending the eyelash along an entirety of the width by applying a last segment to a last portion of the eyelash.

21. The method of claim 18, further comprising adding a cover to the eyelash opposite the substrate.

22. The method of claim 21, further comprising applying the cover as a series of cover segments as additional extension segments.

23. The method of claim 22, wherein the cover segments correspond to the segments of the extension.

* * * * *